US012742597B2

(12) United States Patent
Saltzman et al.

(10) Patent No.: US 12,742,597 B2
(45) Date of Patent: Sep. 22, 2026

(54) ANNULAR PLATE-FIN HEAT EXCHANGER

(71) Applicant: Hamilton Sundstrand Corporation, Charlotte, NC (US)

(72) Inventors: David Saltzman, Glastonbury, CT (US); Erick Ramos, South Windsor, CT (US); Ahsan Akhtar, West Hartford, CT (US); Myles Kelly, Willimantic, CT (US); Marizabeth Serrano, Bloomfield, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 119 days.

(21) Appl. No.: 18/790,886

(22) Filed: Jul. 31, 2024

(65) Prior Publication Data

US 2026/0036374 A1 Feb. 5, 2026

(51) Int. Cl.
*F28D 9/00* (2006.01)

(52) U.S. Cl.
CPC ..... *F28D 9/0012* (2013.01)

(58) Field of Classification Search
CPC ..... F28D 9/0012
See application file for complete search history.

(56) References Cited

U.S. PATENT DOCUMENTS 1,871,322 A * 8/1932 Hodgins ..... F28D 21/0007 165/139
3,228,464 A * 1/1966 Stein ..... F28F 3/046 165/166
3,705,618 A * 12/1972 Jouet ..... F24D 3/082 165/166
3,818,984 A * 6/1974 Nakamura ..... F28F 3/025 165/157
4,438,809 A * 3/1984 Papis ..... F28D 9/0018 165/166
7,648,686 B2 * 1/2010 Reinke ..... B01J 12/007 165/169

(Continued)

FOREIGN PATENT DOCUMENTS

CN 102478365 A 5/2012
CN 102840777 B 8/2016

(Continued)

OTHER PUBLICATIONS

WO2016098617A1 mt (Year: 2016).*
WO2012095947A1 mt (Year: 2012).*

*Primary Examiner* — Gordon A Jones
(74) *Attorney, Agent, or Firm* — Kinney & Lange, P.A.

(57) ABSTRACT

A heat exchanger includes an exhaust shell and an annular core contained within the exhaust shell. The annular core includes a first end, a second end opposite the first end, an outer diameter, and an inner diameter. The annular core further includes a first plurality of fins extending in a first direction between the inner diameter and the outer diameter in a first set of layers. The annular core further includes a second plurality of fins extending in a second direction between the inner diameter and the outer diameter in a second set of layers. The second plurality of fins further includes a first inlet manifold comprising a second inlet and a first outlet manifold comprising a second outlet. The annular core further includes a plurality of plates separating the first set of layers and the second set of layers.

18 Claims, 15 Drawing Sheets

(56) References Cited

U.S. PATENT DOCUMENTS

| | | | | |
|---|---|---|---|---|
| 10,274,265 | B2 | 4/2019 | Kenworthy et al. | |
| 10,406,601 | B2 * | 9/2019 | Martin | F28F 3/12 |
| 10,550,767 | B2 * | 2/2020 | Eleftheriou | F02C 7/08 |
| 11,486,649 | B2 * | 11/2022 | Pawelzik | F24F 12/006 |
| 12,228,342 | B2 * | 2/2025 | Turney | F28D 1/05366 |
| 2019/0346209 | A1 * | 11/2019 | Miller | F28F 9/0131 |
| 2023/0076321 | A1 * | 3/2023 | Saviers | F28D 1/0443 |
| 2024/0011712 | A1 | 1/2024 | Mangoyan et al. | |

FOREIGN PATENT DOCUMENTS

| | | | | |
|---|---|---|---|---|
| CN | 110098695 | A | 8/2019 | |
| WO | WO-2012095947 | A1 * | 7/2012 | F01N 5/02 |
| WO | WO-2014162041 | A1 * | 10/2014 | F28D 9/0006 |
| WO | WO-2016098617 | A1 * | 6/2016 | F28D 9/0043 |

* cited by examiner

ANNULAR PLATE-FIN HEAT EXCHANGER

BACKGROUND

This disclosure relates generally to heat exchangers, and more specifically to plate-fin heat exchangers.

Heat exchangers are well known in many industries for a variety of applications. In mobile applications, particularly for aerospace applications, heat exchangers provide a highly effective means of exchanging heat from a relatively hot fluid to a relatively cold fluid. Plate-fin heat exchangers are one of the most common heat exchanger types used in aerospace applications. Plate-fin heat exchangers typically include flow circuits manufactured out of folded sheet metal with separating sheets in between. Each flow circuit can carry a different temperature fluid, which can be gas, liquid, or two-phase. Thermal energy is transferred between the flow circuits. Typically, there is a primary circuit that must be heated or cooled by the secondary circuit.

SUMMARY

In one example, a heat exchanger includes an exhaust shell and an annular core contained within the exhaust shell. The annular core includes a first end, a second end that is axially opposite to the first end, an outer diameter defining an outer surface, and an inner diameter defining an inner surface. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold comprising a second inlet and a first outlet manifold fluidly connected to the first inlet manifold, the first outlet manifold comprising a second outlet. The second inlet branches into a first set of tubes that connect to the second set of layers at a first region. The second outlet branches into a second set of tubes that connect to the second set of layers at a second region. The annular core further includes a plurality of plates separating the first set of layers and the second set of layers.

In another example, a heat exchanger includes an exhaust shell and an annular core contained within the exhaust shell. The annular core includes a first end, a second end that is axially opposite to the first end, an outer diameter defining an outer surface, and inner diameter defining an inner surface. The inner diameter changes from the first end to the second end. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold and a first outlet manifold fluidly connected to the first inlet manifold. The annular core further includes a plurality of plates separating the first set of layers from the second set of layers.

In another example, a heat exchange system includes a heat exchanger and a fan that is positioned within an annular core of the heat exchanger. The heat exchanger includes an exhaust shell, an annular core contained within the exhaust shell, and an exhaust tube connected to the exhaust shell.

The annular core includes a first end; a second end axially opposite to the first end; an outer diameter extending between the first end and the second end, the outer diameter defining an outer surface; and an inner diameter extending between the first and the second end, the inner diameter defining an inner surface. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold and a first outlet manifold fluidly connected to the first inlet manifold. The first inlet manifold includes a second inlet, and the second inlet branches into a first set of tubes that connect to the second set of layers at a first region. The first outlet manifold includes a second outlet, and the second outlet branches into a second set of tubes that connect to the second set of layers at a second region. The annular core further includes a plurality of plates separating the first set of layers and the second set of layers.

BRIEF DESCRIPTION OF THE DRAWINGS

Annular PFHX 10

Annular PFHX 210A-210H

Figure 7A:
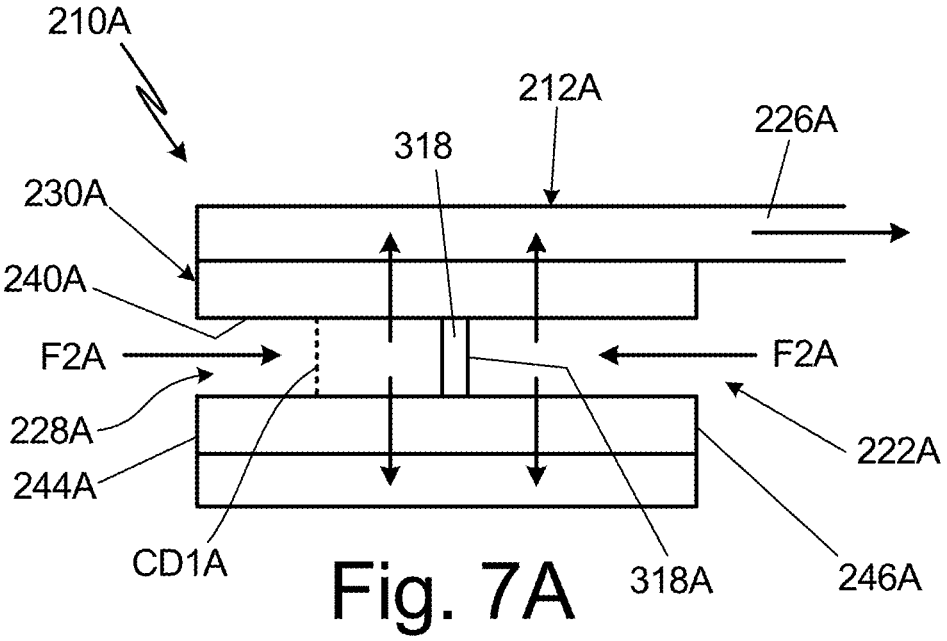

FIG. 7A is a schematic cross-sectional view of an annular PFHX showing a first example of a core including a flow directing structure.

Figure 7B:
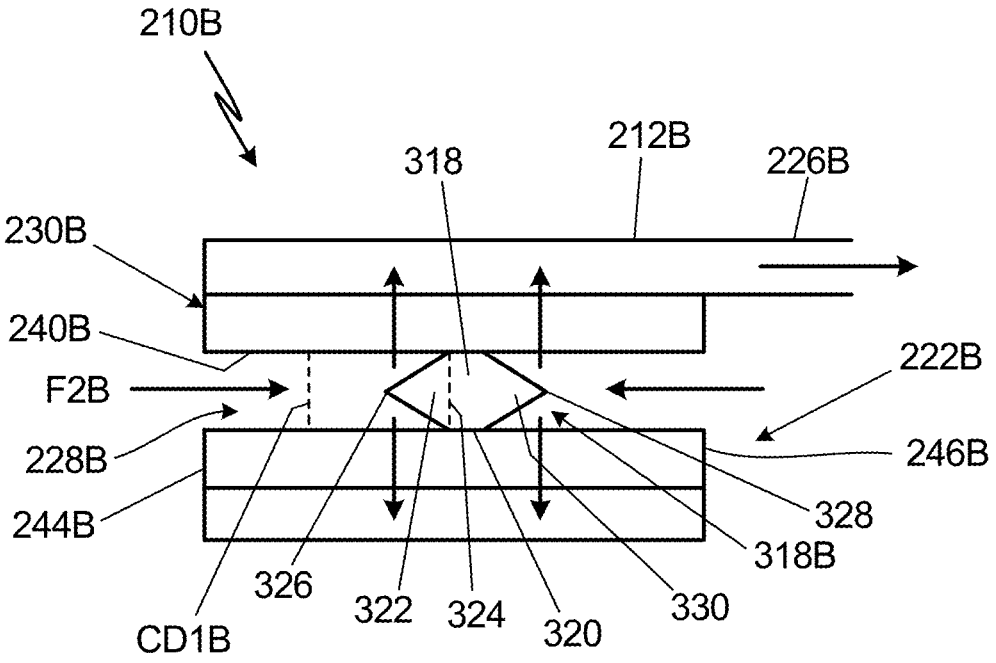

FIG. 7B is a schematic cross-sectional view of an annular PFHX showing a second example of a core including a flow directing structure.

Figure 7C:
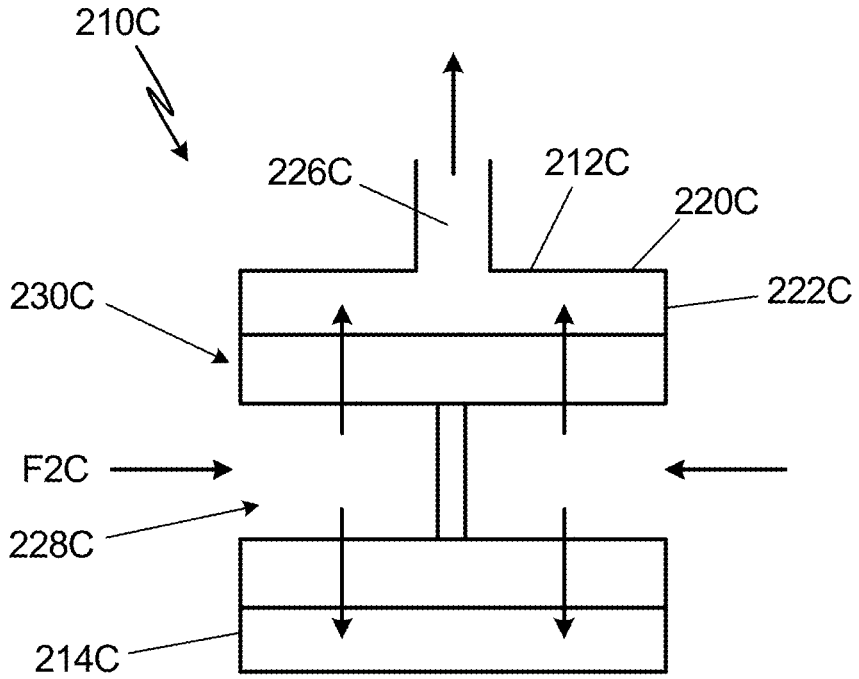

FIG. 7C is a schematic cross-sectional view of an annular PFHX showing a first example of a shell.

Figure 7D:
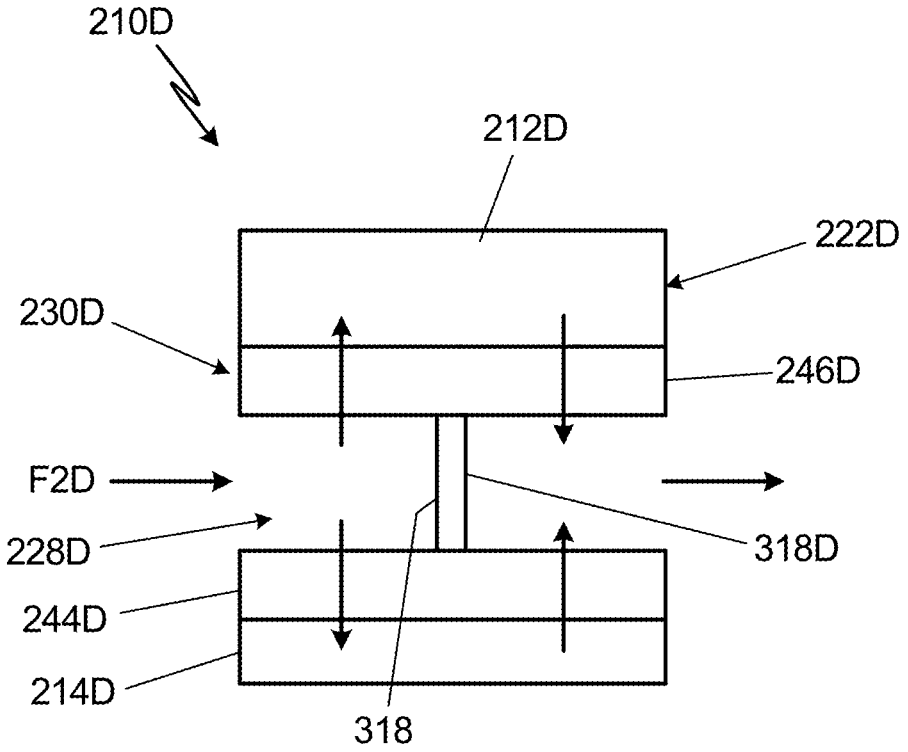

FIG. 7D is a schematic cross-sectional view of an annular PFHX showing a second example of a shell.

Figure 7E:
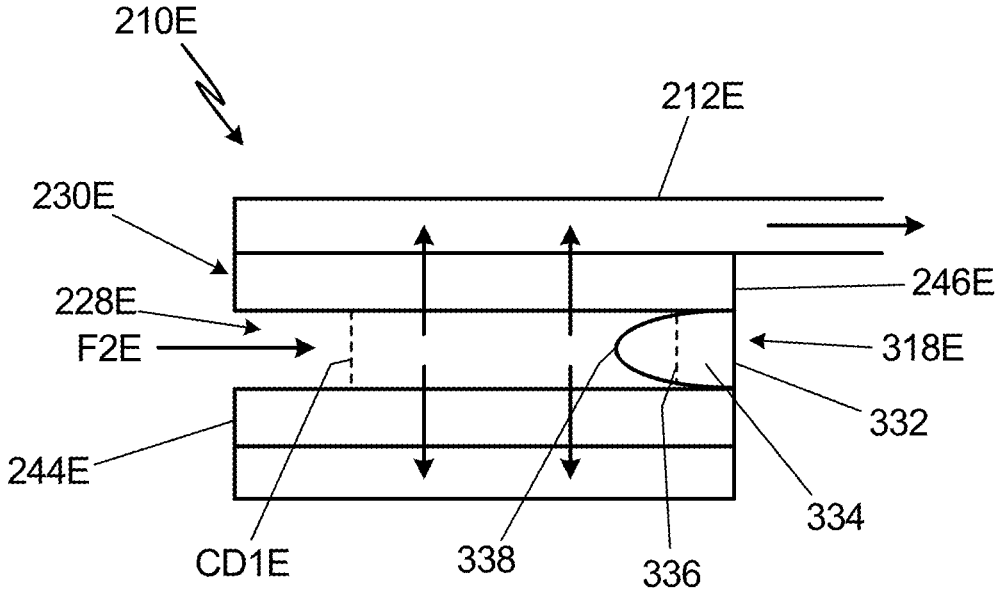

FIG. 7E is a schematic cross-sectional view of an annular PFHX showing a third example of a core including a flow directing structure.

Figure 7F:
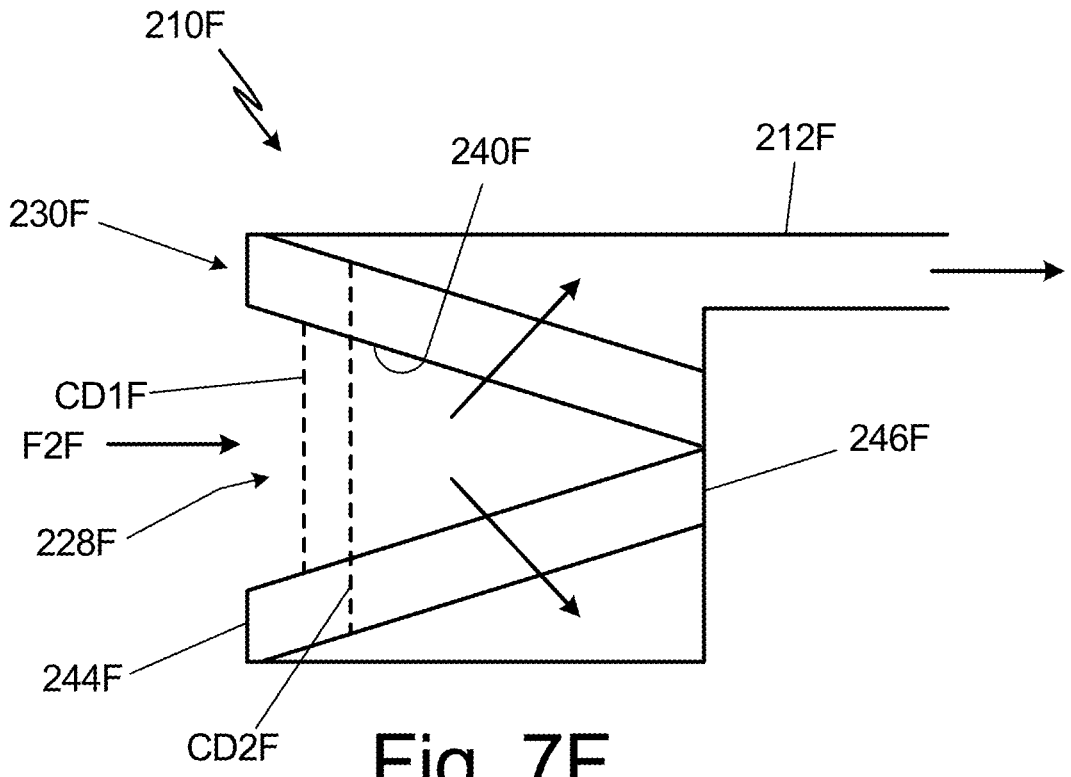

FIG. 7F is a schematic cross-sectional view of an annular PFHX showing a first example of a tapered core.

Figure 7G:
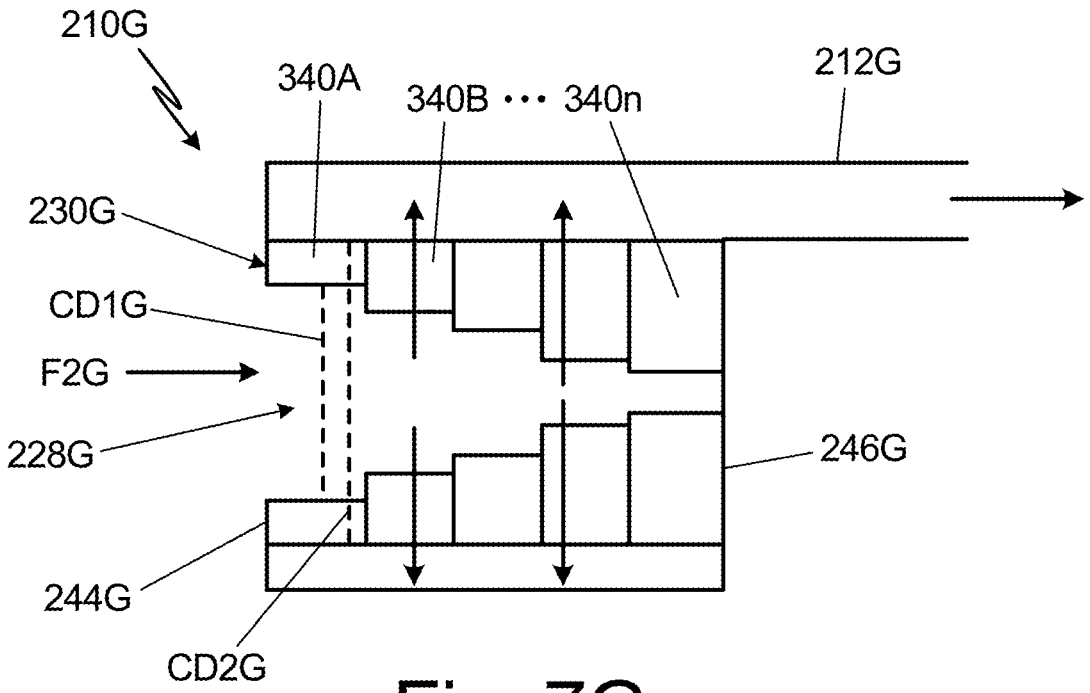

FIG. 7G is a schematic cross-sectional view of an annular PFHX showing a second example of a tapered core.

Figure 7H:
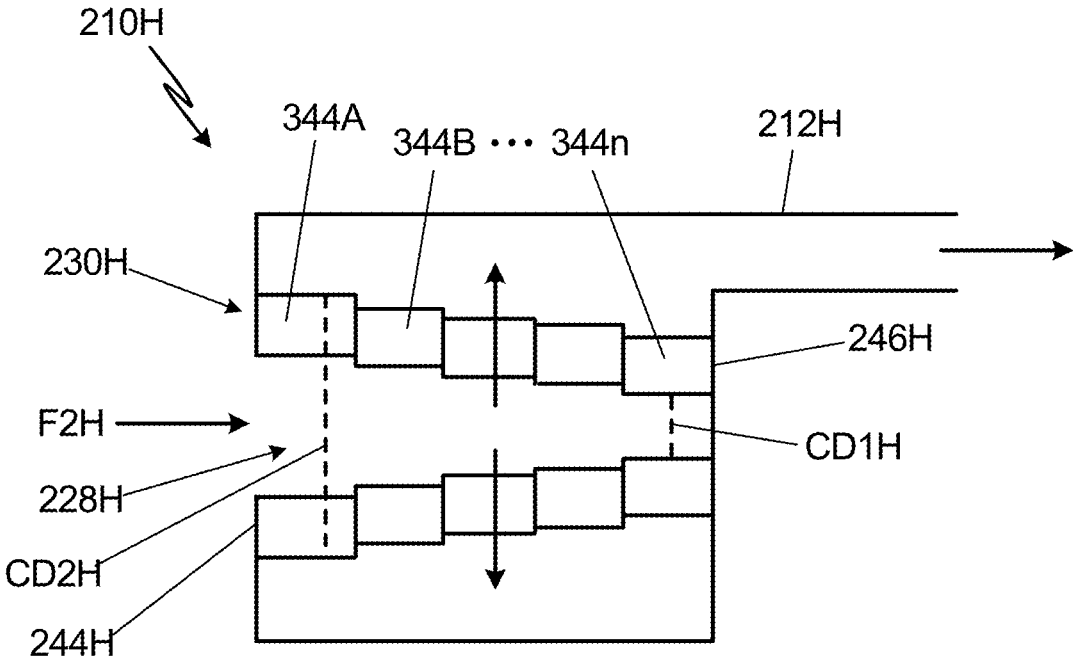

FIG. 7H is a schematic cross-sectional view of an annular PFHX showing a third example of a tapered core.

Annular PFHX 410

Figure 8B:
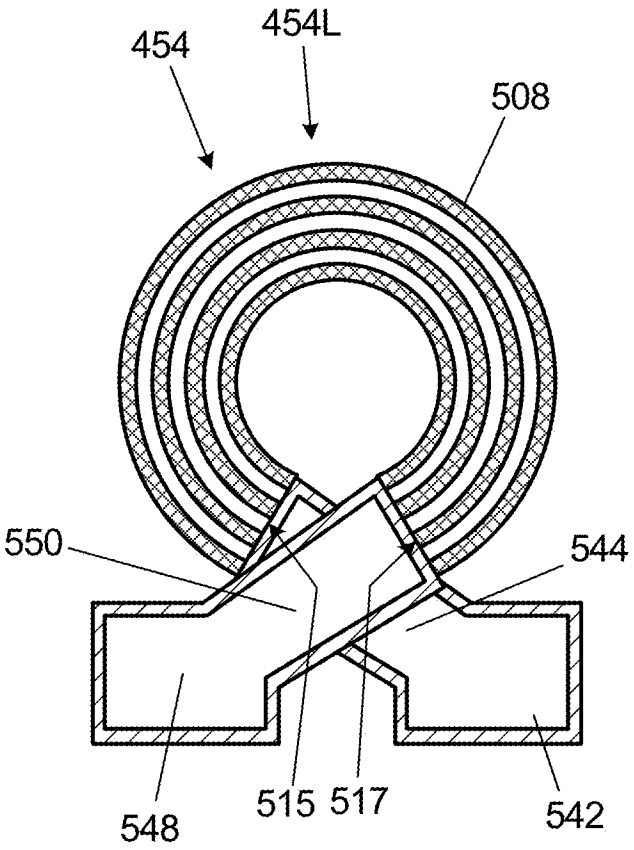
Figure 8A:
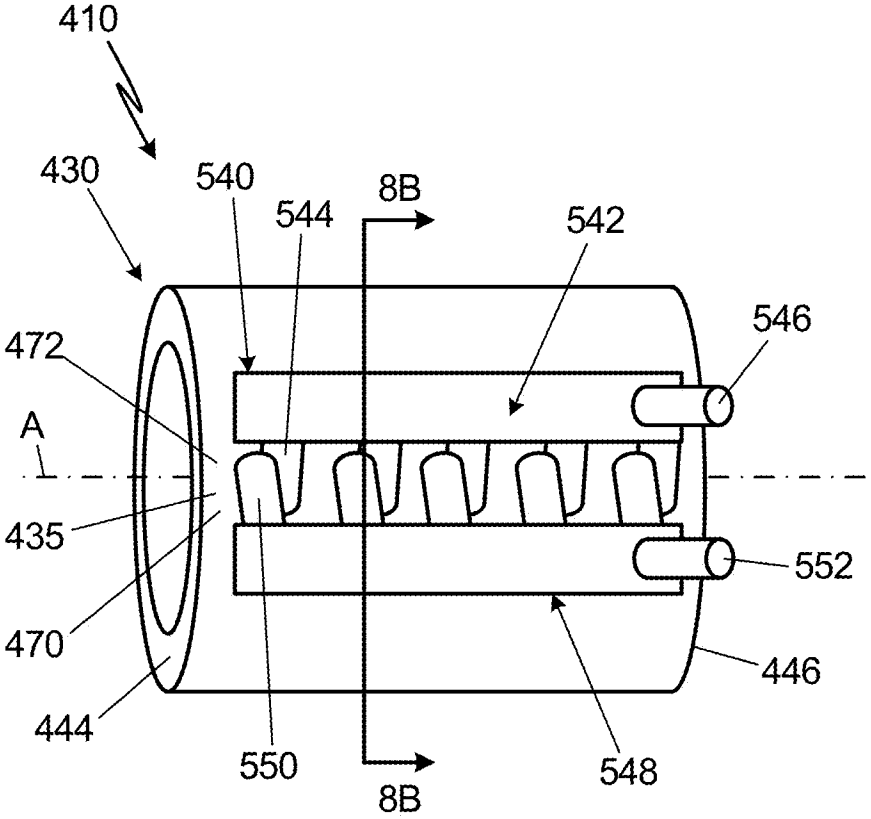

FIG. 8A is an oblique projection view of an annular PFHX including a cross-over manifold.

FIG. 8B is a schematic cross-sectional top view of the annular PFHX of FIG. 8A taken at line 8B-8B.

Heat Exchange System 600

Figure 9:
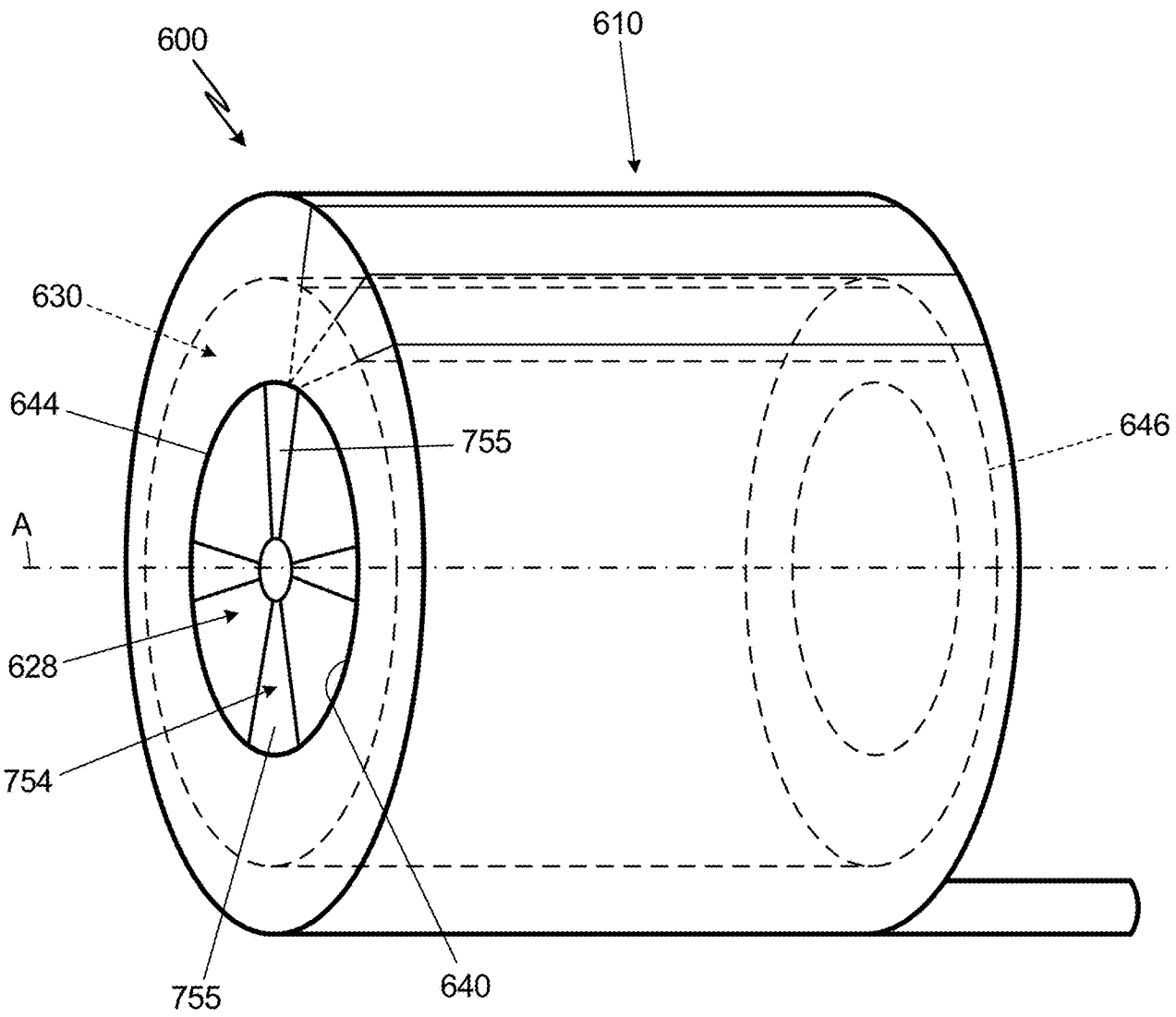

FIG. 9 is an oblique projection view of an annular heat exchange system showing an annular PFHX and a fan.

DETAILED DESCRIPTION

Introduction

In general, the present disclosure relates to an annular plate-fin heat exchanger (PFHX). The annular PFHX can include a shell and an annular core within the shell. The core can include at least a primary flow circuit, a secondary flow circuit, separating plates, and fins. The primary circuit and secondary circuit are each generally configured to carry fluid of different temperatures. The separating plates can be configured to separate the different temperature fluids by separating the primary and secondary circuit and provide heat transfer therebetween. The fins can provide structural support and additional heat transfer surface area.

The annular PFHX can be applied to aerospace applications. For example, the annular PFHX can be used for ram-air circuit applications. In such applications, the annular PFHX can facilitate heat transfer between the fluid of a primary circuit and the fluid of a secondary circuit. The primary circuit can receive a fluid that is relatively hot. For example, the relatively hot fluid may be hot oil flowing from an aircraft. The secondary circuit can receive a fluid that is relatively cold. For example, the relatively cold fluid may be ram air generated from the movement of the aircraft. Heat from the relatively hot fluid can transfer to the relatively cold fluid to cool the hot oil that flows back into the aircraft. In such applications, a large inlet face to receive the relatively cold fluid is favorable to reduce pressure drop and increase flow through the secondary circuit. However, large inlet face designs are typically limited due to aerospace platform constraints, such as space and weight limitations.

The annular PFHX described herein can have a relatively small profile suitable for aerospace applications and may be configured to increase fluid flow through both the primary circuit and secondary circuit and improve heat transfer.

An annular PFHX according to techniques of the present disclosure is described below with reference to FIGS. 1A-6C. Several examples of annular PFHXs including various flow directing structures, shell configurations, and tapered cores are described below with reference to FIGS. 7A-7H. An example of an annular PFHX including a cross-over manifold is described below with reference to FIGS. 8A-8B. A heat exchange system including an annular PFHX and a fan is described below with reference to FIG. 9. One or more features disclosed in connection with one example may be utilized in combination with one or more features of another example, even if such a combination is not explicitly referenced.

Annular PFHX 10 (FIGS. 1A-6C)

Figure 1A:
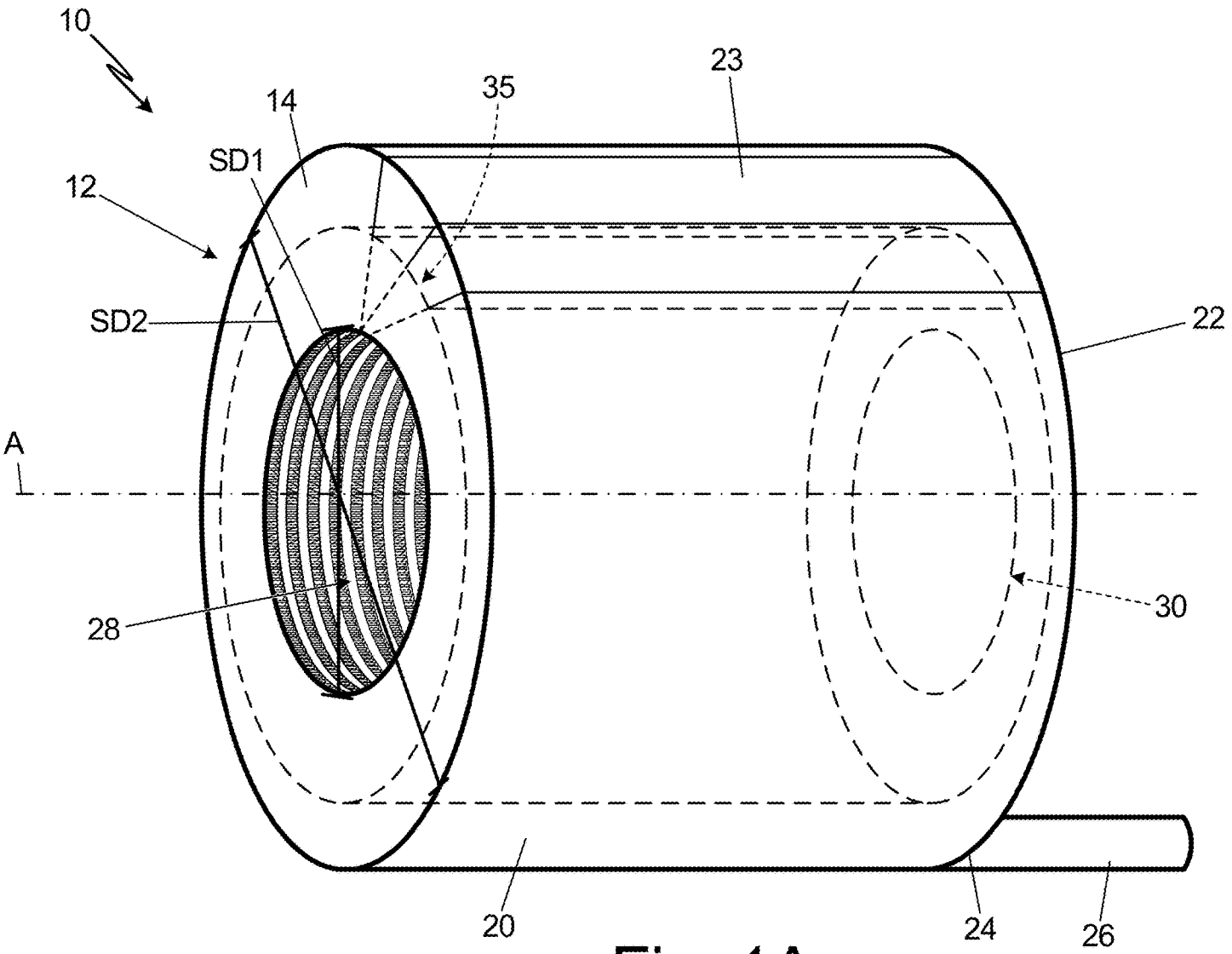
FIG. 1A is an oblique projection view of an annular plate-fin heat exchanger (PFHX).
Figure 1C:
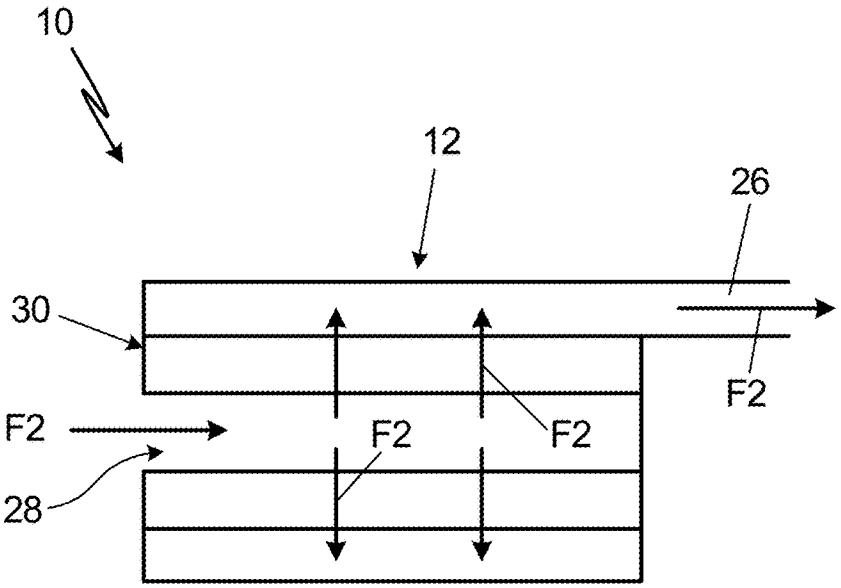
FIG. 1C is a schematic cross-sectional view of the annular PFHX of FIG. 1A showing a secondary flow pathway.
Figure 1B:
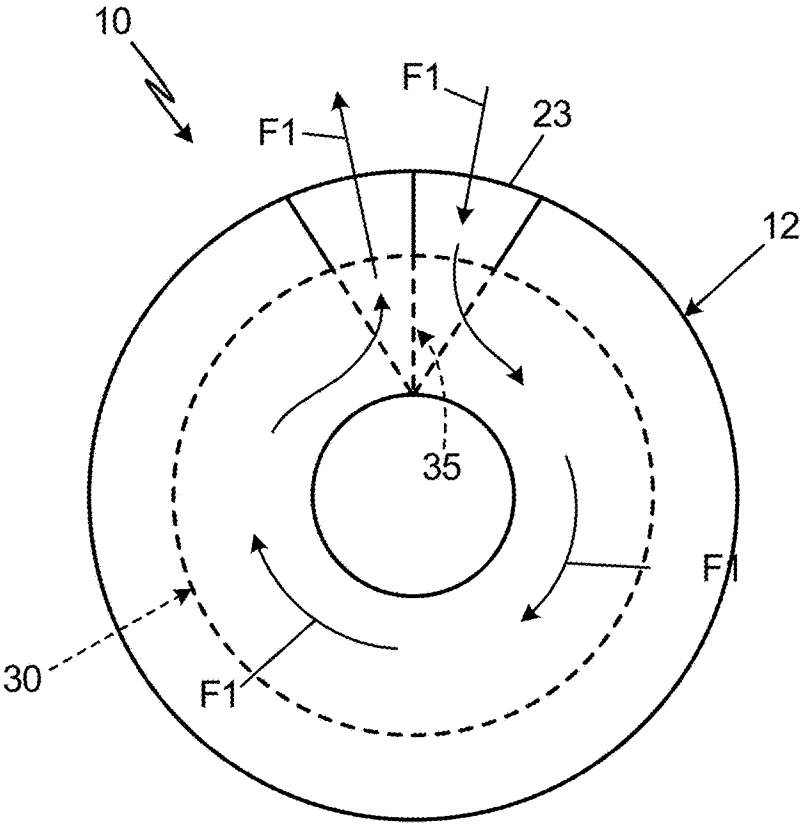
FIG. 1B is a schematic end view of the annular PFHX of FIG. 1A showing a primary flow pathway.
Figure 2A:
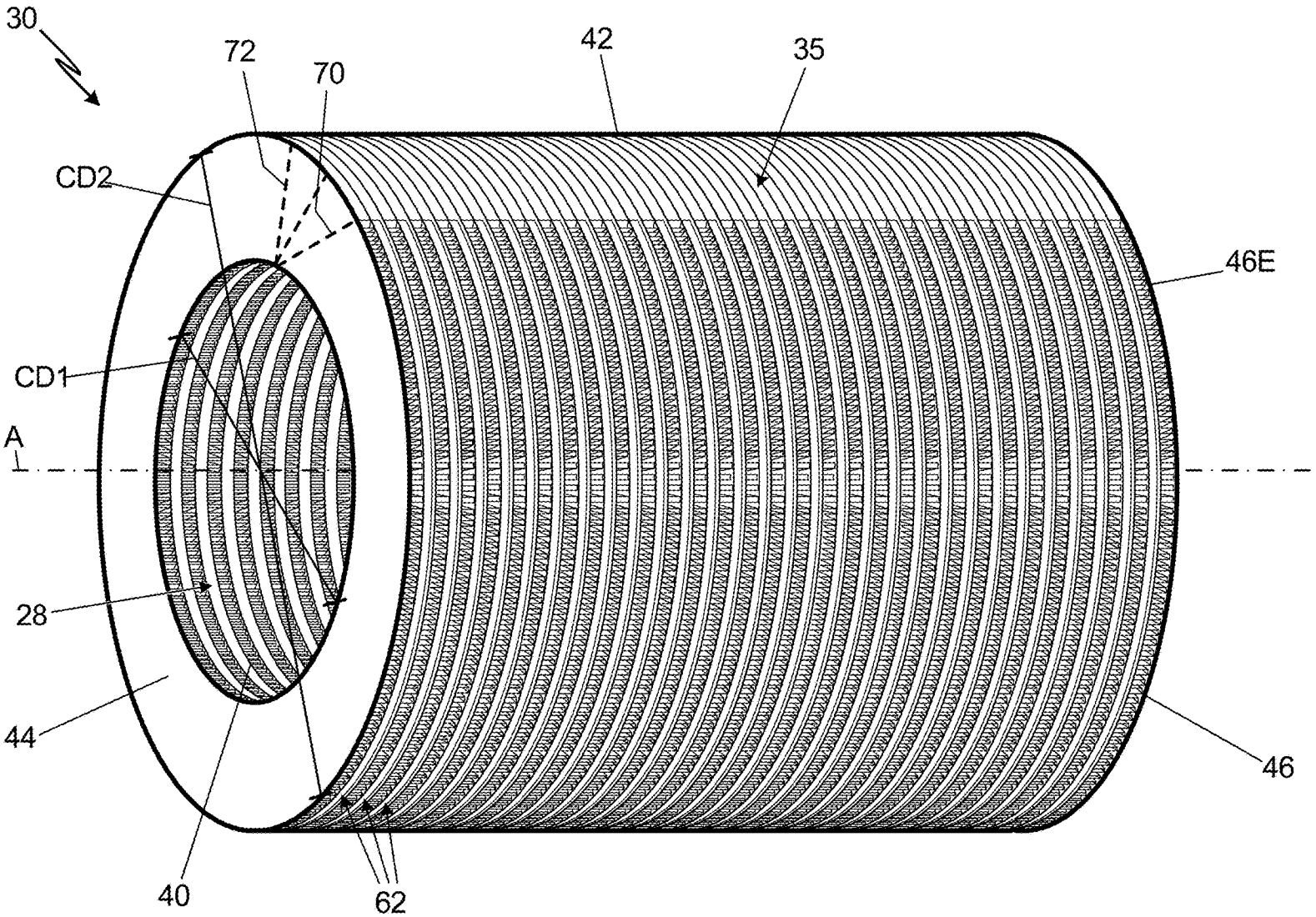
FIG. 2A is an oblique projection view of a core of the annular PFHX of FIG. 1A.
Figure 2B:
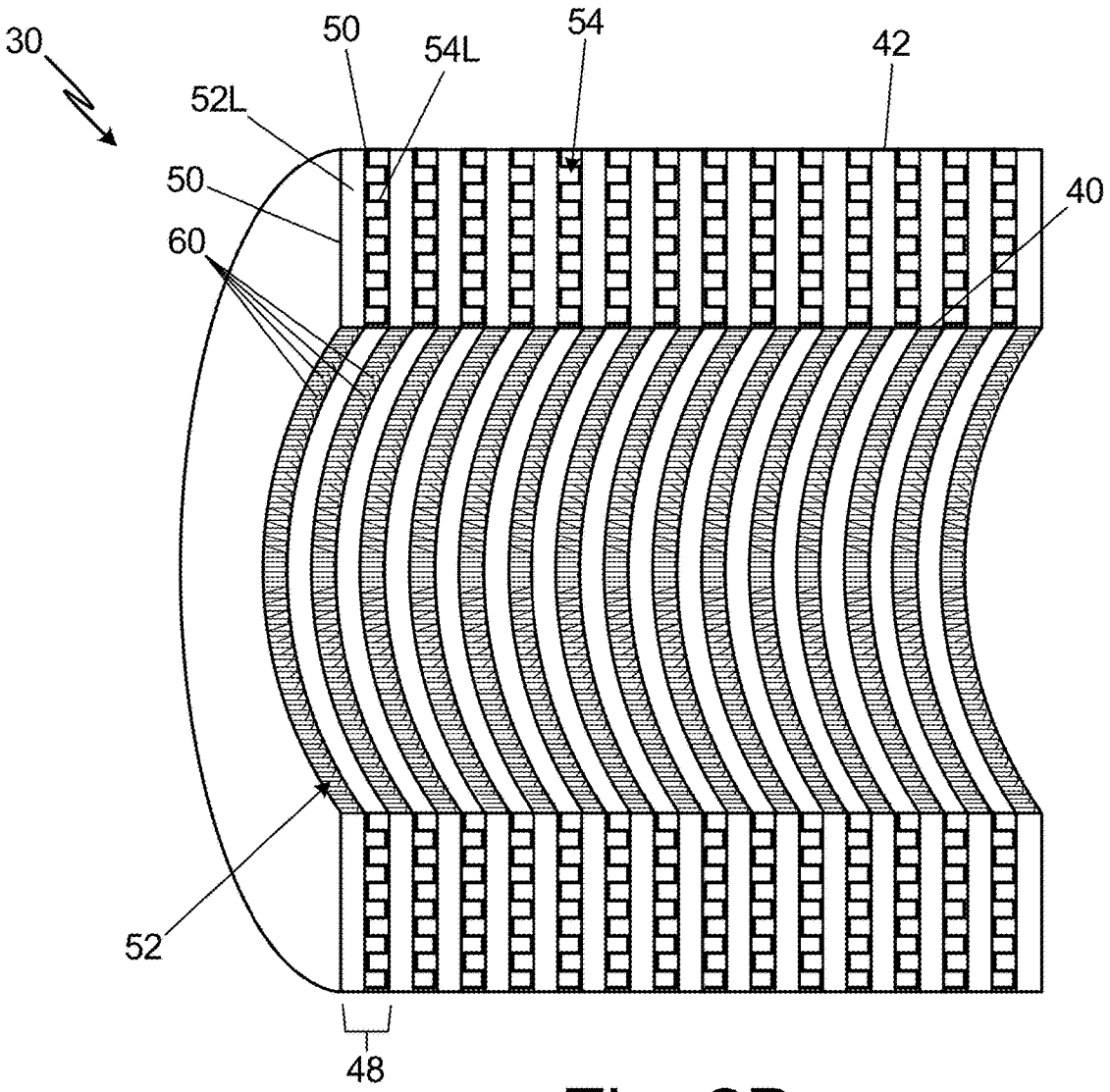
FIG. 2B is a cross-sectional oblique projection view of the core showing an inner surface.
Figure 3:
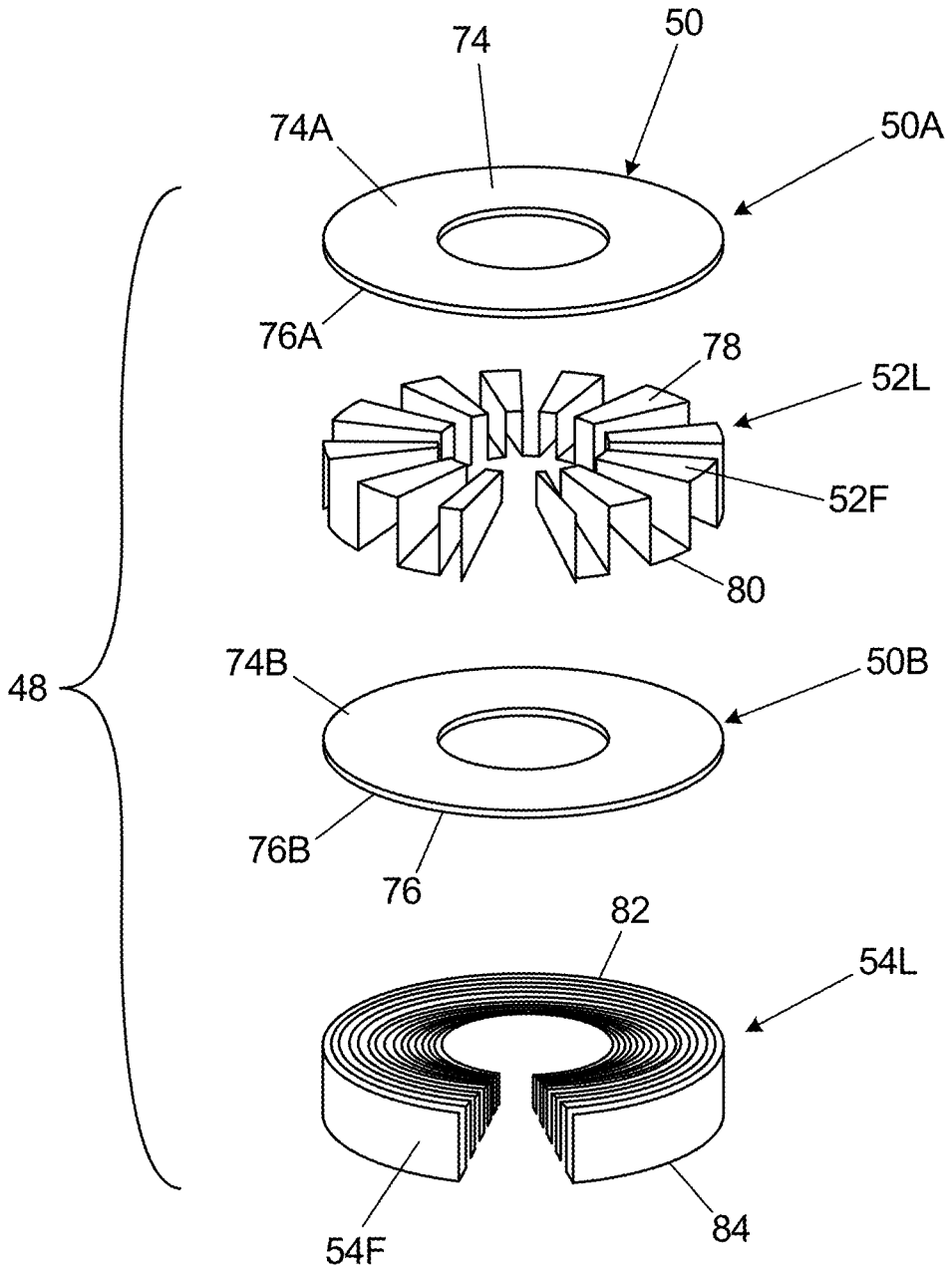
FIG. 3 is an exploded view of a unit of plate-fin layers of the core.

Annular PFHX 10 is described with respect to FIGS. 1A-6C. In some examples, annular PFHX 10 includes a shell and a core, as will be described further in FIGS. 1A-2B. In some examples, the core further includes repeating units of plate-fin layers, as shown in FIG. 3. In some examples, each unit of plate fin layers include radial flow channels and circumferential flow channels separated by separating plates, as will be described with respect to FIGS. 3-6C.

FIGS. 1A-1C

For clarity and case of discussion, FIGS. 1A-1C will be described together. FIG. 1A is an oblique projection view of annular plate-fin heat exchanger (PFHX) 10. FIG. 1B is a schematic end view of annular PFHX 10 showing primary flow pathway F1. FIG. 1C is a schematic cross-sectional view of annular PFHX 10 showing secondary flow pathway F2.

FIG. 1A shows annular PFHX 10, including shell 12 (which includes first end 14, inner diameter SD1, outer diameter SD2, shell body 20, second end 22, outer portion 23, and exhaust bore 24), exhaust tube 26, central bore 28, and core 30. Core 30 includes header region 35. FIG. 1A also shows longitudinal axis A. FIG. 1B shows annular PFHX 10, shell 12 (including outer portion 23), core 30 (including header region 35), and primary flow pathway F1. FIG. 1C shows annular PFHX 10, shell 12, exhaust tube 26, central bore 28, core 30, and secondary flow pathway F2.

Annular PFHX 10 can have an overall annular or cylindrical shape. Annular PFHX 10 is centered about longitudinal axis A. Annular PFHX 10 can include shell 12 and core 30.

Shell 12 is an exterior casing or shroud around other components of annular PFHX 10 and can be centered about longitudinal axis A. In the example of FIGS. 1A-1C, shell 12 has a generally cylindrical shape; however, it should be understood that in other examples, shell 12 can be a different shape. For example, shell 12 can be any suitable shape to accommodate core 30.

Shell 12 includes first end 14 and second end 22. First end 14 of shell 12 can be an annular surface at one end of annular PFHX 10. First end 14 extends circumferentially about longitudinal axis A and has a radial thickness from inner diameter SD1 to outer diameter SD2. Second end 22 is at an end of annular PFHX 10 that is longitudinally opposite first end 14. In some examples, second end 22 of shell 12 can be a generally circular closed surface. In other examples, second end 22 of shell 12 can be an annular surface that extends circumferentially about longitudinal axis A and has a radial thickness from inner diameter SD1 to outer diameter SD2. That is, in some examples both first end 14 and second end 22 form open ends of annular PFHX 10 and shell 12.

Shell body 20 extends longitudinally from first end 14 of shell 12 to second end 22 of shell 12. Outer diameter SD2 defines an exterior surface of shell body 20. Shell body 20 can further include outer portion 23 (shown schematically in FIG. 1A) that is configured to deliver fluid to and receive fluid from core 30 (as shown by the dashed lines within shell body 20 FIG. 1A). In some examples, outer portion 23 is adjacent to inlet and outlet ducts connected to or extending from core 30. In other examples, outer portion 23 includes an integrated wall or walls of an inlet and outlet manifold connected to or extending from core 30.

Shell 12 can further include exhaust bore 24 that is configured to mate with exhaust tube 26. In one example, exhaust bore 24 can be positioned on second end 22 of shell 12. In some examples, exhaust tube 26 is cylindrical, and exhaust bore 24 is correspondingly circular. In other examples, exhaust tube 26 may be a different three-dimensional shape, and exhaust bore 24 is configured to connect to receive the three-dimensional shape. Exhaust tube 26 can be connected to external ducting or other components of a heat exchange system.

The opening in the annular surface of first end 14 defines central bore 28. Central bore 28 extends longitudinally from first end 14 to second end 22 of shell 12 through annular PFHX 10. Central bore 28 is surrounded by core 30. Core 30 can be generally annular and centered about longitudinal axis A. Core 30 can be positioned within shell 12 such that core 30 extends from first end 14 of shell 12 to second end 22 of shell 12. Core 30 can further include header region 35 that is radially aligned with outer portion 23 of shell body 20 and configured to deliver and receive fluid to and from core 30.

Collectively, outer portion 23 of shell 12, header region 35 of core 30, and core 30 are in fluid communication to provide primary flow pathway F1 through annular PFHX 10. For example, as indicated by the arrows in FIG. 1B, a primary fluid can enter annular PFHX 10 at outer portion 23. The primary fluid enters core 30 through header region 35. The primary fluid flows circumferentially through core 30. As the primary fluid flows through core 30, it exchanges heat with a secondary fluid before exiting core 30 through header region 35. The primary fluid exits annular PFHX 10 at outer portion 23. In some examples, the primary fluid is at a higher temperature compared to the secondary fluid. For example, the primary fluid exchanges heat with the secondary fluid such that the primary fluid dissipates heat to the secondary fluid. In other examples, the primary fluid is at a lower temperature compared to the secondary fluid and the heat exchange relationship is reversed.

The secondary fluid flows through secondary flow pathway F2. Secondary flow pathway F2 is provided by central bore 28, core 30, and exhaust tube 26, which are in fluid communication. For example, as indicated by the arrows in FIG. 1C, the secondary fluid enters annular PFHX 10 through central bore 28. The secondary fluid flows longitudinally within central bore 28 and radially enters core 30. The secondary fluid flows radially through core 30 and is in a heat exchange relationship with the primary fluid, for example, such that it receives heat dissipated by the primary fluid. The secondary fluid exits core 30 radially and enters shell 12. The secondary fluid travels longitudinally and circumferentially within shell 12. The secondary fluid is discharged from annular PFHX 10 through exhaust tube 26.

Although primary flow pathway F1 and secondary flow pathway F2 are referred to herein in the flow directions described above for simplicity, it should be understood that the flow directions of primary flow pathway F1 and secondary flow pathway F2 could be reversed in other examples. That is, in other examples, components referred to as "inlets" could generally function as outlets and components referred to as "outlets" could generally function as inlets.

Secondary flow pathway F2 facilitates a separate fluid flow from primary flow pathway F1. For example, the primary fluid can be a different fluid from the secondary fluid. In one example, either the primary fluid or the secondary fluid can be ram airflow, which may be used to cool a relatively higher temperature fluid. The primary fluid and the secondary fluid flow through different regions of annular PFHX 10 and generally are prevented from physically mixing.

FIGS. 2A-2B

For clarity and case of discussion, FIGS. 2A-2B will be described together. FIG. 2A is an oblique projection view of core 30. FIG. 2B is a cross-sectional view of core 30 showing inner surface 40. Core 30 includes header region 35, inner diameter CD1, outer diameter CD2, radially inner surface 40, radially outer surface 42, first end 44, second end 46 (including end plate 46E), units 48 (including separating plates 50, layers 52L, and layers 54L), radial flow circuit 52, circumferential flow circuit 54, radial inlets 60, and radial outlets 62. Header region 35 includes first end 70 and second end 72.

FIGS. 2A-2B show core 30, radially inner surface 40, and radially outer surface 42. FIG. 2A further shows central bore 28, inner diameter CD1, outer diameter CD2, first end 44, second end 46 (including end plate 46E), radial outlets 62, and header region 35 (including first end 70 and second end 72). FIG. 2A further shows longitudinal axis A. FIG. 2B further shows units 48 (including separating plates 50, layers 52L, and layers 54L), radial flow circuit 52, circumferential flow circuit 54, and radial inlets 60.

Core 30 can be annular and centered about longitudinal axis A such that it surrounds central bore 28. Core 30 can extend circumferentially about longitudinal axis A and can have a radial thickness from inner diameter CD1 to outer diameter CD2. Inner diameter CD1 of core 30 defines radially inner surface 40, and outer diameter CD2 of core 30 defines radially outer surface 42. Inner surface 40 and outer surface 42 collectively extend along longitudinal axis A from first end 44 to second end 46 to form a main body of core 30. That is, core 30 has an axial length from first end 44 to second end 46. First end 44 of core 30 can be connected or adjacent to first end 14 of shell 12, and second end 46 of core 30 can be connected or adjacent to the second end 22 of shell 12. In some examples, inner diameter CD1 of core 30 is equal to inner diameter SD1 of shell 12, and outer diameter CD2 is less than outer diameter SD2 of shell 12. In other examples, inner diameter CD1 is different than inner diameter SD1 of shell 12.

Core 30 can be open at first end 44. Core 30 can further include end plate 46E at second end 46. End plate 46E closes the last plate-fin layer of core 30 (i.e., the plate-fin layer that is closest to second end 46). In some examples, end plate 46E can be annular and core 30 can be open at second end 46. In other examples, end plate 46E can be generally circular and core 30 can be closed at second end 46.

As shown in FIG. 2B, core 30 can further include repeating annular units 48 of plate-fin layers. Units 48 can be centered and extend circumferentially about longitudinal axis A. Units 48 can have corresponding radial thicknesses from inner diameter CD1 of core 30 to outer diameter CD2 of core 30. Units 48 can repeat from first end 44 of core 30 to second end 46 of core 30. Core 30 can include any number of units 48. A relatively first unit 48 is located at first end 44 of core 30. A relatively last unit 48 is located at second end 46 of core 30.

Each unit 48 of plate-fin layers can include two separating plates 50, one layer 52L of radial flow circuit 52, and one layer 54L of circumferential flow circuit 54. Radial flow circuit 52 includes layers 52L and can define a plurality of pathways through core 30 associated with secondary flow pathway F2. Circumferential flow circuit 54 includes layers 54L and can define a plurality of pathways through core 30 associated with primary flow pathway F1. Separating plates 50 can separate radial flow circuit 52 from circumferential flow circuit 54. The plate-fin layers of unit 48 can be stacked towards second end 46 of core 30. In some examples, a first separating plate 50 is followed by one layer 52L of radial flow circuit 52, the one layer 52L of radial flow circuit 52 is followed by a second separating plate 50, and the second separating plate 50 is followed by one layer 54L of circumferential flow circuit 54. In other examples, the one layer 52L of radial flow circuit 52 is positionally interchanged with the one layer 54L of circumferential flow circuit 54 within the plate-fin sequence of unit 48.

Each layer of unit 48 can be connected to adjacent layers within unit 48, and each unit 48 can be connected to adjacent units 48. Units 48 can be repeatedly stacked along longitudinal axis A until the relatively last unit 48 reaches the second end 46 of core 30. The last unit 48 can be connected to end plate 46E to close off second end 46. Each layer within units 48 (including separating plates 50, layers 52L of radial flow circuit 52, and layers 54L of circumferential flow circuit 54) can be oriented to be generally parallel to first end 44 and second end 46 of core 30. In some examples, units 48 (and the layers of each unit 48) are connected by a method of stacking and brazing.

With continued reference to FIG. 2A-2B, core 30 includes inner surface 40 at inner diameter CD1 of core 30. An inner face of unit 48 can be defined by inner diameter CD1 of core 30. The inner faces of repeated stacks of unit 48 can form inner surface 40. A plurality of radial inlets 60 can be positioned on inner surface 40, from first end 44 of core 30 to second end 46 of core 30. Specifically, radial inlets 60 can be positioned adjacent to one another and arranged circumferentially around regions of inner surface 40 formed by layers 52L of radial flow circuit 52 but outside of header region 35. Radial inlets 60 can be separated in a longitudinal direction by a length of two separating plates 50 and one layer 54L of circumferential flow circuit 54. In some examples, each radial inlet 60 on a respective layer 52L of radial flow circuit 52 can be a rectangular bore that opens into the respective layer 52L of radial flow circuit 52.

Central bore 28 is surrounded by inner surface 40 and is in fluid communication with radial flow circuit 52 through radial inlets 60. In some examples, the secondary fluid flows through central bore 28 and enters radial flow circuit 52 through radial inlets 60. The secondary fluid can flow radially from inner diameter CD1 of core 30 to outer diameter CD2 of core 30.

An outer face of unit 48 is defined by outer diameter CD2 of core 30. The outer faces of repeated stacks of unit 48 can form outer surface 42. A plurality of radial outlets 62 can be positioned on outer surface 42, from first end 44 of core 30 to second end 46 of core 30. Specifically, radial outlets 62 can be positioned on regions of outer surface 40 formed by layers 52L of radial flow circuit 52 but outside of header region 35. Radial outlets 62 can be separated in a longitudinal direction by a length of two separating plates 50 and one layer 54L of circumferential flow circuit 54. In some examples, each radial outlet 62 on a respective layer 52L of radial flow circuit 52 can be a rectangular bore of radial flow circuit 52 that defines the end of a radial flow pathway through radial flow circuit 52. More specifically, each radial outlet 62 can be continuous with a corresponding one of radial inlets 60. In some examples, the secondary fluid flows radially through radial flow circuit 52 and exits core 30 through radial outlets 52.

FIG. 2B shows circumferential flow circuit 54 of core 30 in cross-section. Each layer 54L of circumferential flow circuit 54 includes a plurality of circumferentially extending flow paths. The plurality of flow paths of a respective layer 54L of circumferential flow circuit 54 can be adjacent to one another. Each layer 54L of circumferential flow circuit 54 extends circumferentially and can have a radial thickness spanning from inner diameter CD1 of core 30 to outer diameter CD2 of core 30. Each of the plurality of flow paths of circumferential flow circuit 54 can have a rectangular cross section. Likewise, each layer 52L of radial flow circuit 52 includes a plurality of radially extending flow paths. The plurality of flow paths of a respective layer 52L of radial flow circuit 52 can be adjacent to one another. Each layer 52L of radial flow circuit 52 extends circumferentially and can have a radial thickness spanning from inner diameter CD1 of core 30 to outer diameter CD2 of core 30. Each of the plurality of flow paths of radial flow circuit 52 can have a rectangular cross section.

Core 30 can further include header region 35. Header region 35 can be aligned with outer portion 23 of shell 12 (shown in FIG. 1A). Header region 35 can be connected to a manifold or ducting and can be separate or integrally formed with shell 12. For example, as will be described in greater detail below with reference to FIGS. 8A-8B, header region 35 can include a cross-over manifold. Header region 35 includes first end 70 and second end 72. First end 70 can serve as an inlet (or a portion of an inlet) for circumferential flow circuit 54, and second end 72 can serve as an outlet (or a portion of an outlet) for circumferential flow circuit 54. For example, first end 70 can include a plurality of circumferential inlets and second end 72 can include a plurality of circumferential outlets that make up respective ends of layers 54L of circumferential flow circuit 54, as will be described in greater detail below. In some examples, each circumferential inlet and outlet on a respective layer 54L of circumferential flow circuit 54 can be a rectangular bore of circumferential flow circuit 54 that defines the respective end of a circumferential flow pathway through circumferential flow circuit 54.

As shown in FIG. 2A, circumferential flow circuit 54 of core 30 can extend a partial circumference around central bore 28 from first end 70 of header region 35 to second end 72 of header region 35. First end 70 and second end 72 of header region 35 extend radially between inner diameter CD1 and outer diameter CD2 of core 30. First end 70 and second end 72 of header region 35 extend longitudinally between first end 44 and second end 46 of core 30. In some examples, first end 70 and second end 72 of header region 35 are joined at inner diameter CD1 along inner surface 40. In other examples, first end 70 and second end 72 are separated by an arclength defining a gap in inner surface 40. First end 70 and second end 72 can diverge radially (i.e., extend gradually away from one another) while extending towards outer diameter CD2 of core 30, such that first end 70 and second end 72 are farthest apart along an arclength of outer diameter CD2. The arclength of outer diameter CD2 and the lengths of first end 70 and second end 72 extending between inner diameter CD1 and outer diameter CD2 of core 30 can collectively define the bounds of a wedge-shaped gap separating the first end 70 and second end 72. This wedge-shaped gap can make up a three-dimensional pie slice shape of header region 35. In some examples, the primary fluid enters circumferential flow circuit 54 through first end 70 header region 35. The primary fluid can travel circumferentially through circumferential flow circuit 54 and exit circumferential flow circuit 54 through second end 72 of header region 35.

FIG. 3

FIG. 3 is an exploded view of one unit 48 of core 30 showing two separating plates 50 (including first separating plate 50A and second separating plate 50B), one layer 52L of radial flow circuit 52, and one layer 54L of circumferential flow circuit 54. Unit 48 includes separating plates 50, layer 52L, and layer 54L. Separating plates 50 include upper surface 74 and lower surface 76. Specifically, first separating plate 50A includes upper surface 74A and lower surface 76A, and second separating plate 50B includes upper surface 74B and lower surface 76B. Layer 52L includes radial fins 52F, and layer 54L includes circumferential fins 54F. Layer 52L further includes upper radial surface 78 and lower radial surface 80. Layer 54L further includes upper circumferential surface 82 and lower circumferential surface 84.

Layers 52L of radial flow circuit 52 and layers 54L of circumferential flow circuit 54 are layers of fin configurations that can extend between inner diameter CD1 of core 30 and outer diameter CD2 of core 30. In some examples, each layer 52L and 54L of flow circuits 52 and 54, respectively, is an annular sheet of metal, and each sheet of metal is folded into fins. Each fin can include an upper surface and lower surface. For purposes of clarity, the terms "peak", "trough", "upper", and "lower" are intended to convey relative positions along longitudinal axis A. For example, "peak" and "upper" are intended to convey a relative position that is closer to first end 44 of core 30 than a position conveyed by "trough" and "lower."

As shown in FIG. 3, separating plates 50 can be generally flat and relatively thin annular sheets. Within units 48, separating plates 50 can include first separating plate 50A and second separating plate 50B. First separating plate 50A and second separating plate 50B can have generally the same structure and function but can be arranged in different positions in the stacked structure of each unit 48. Each separating plate 50 includes upper surface 74 and lower surface 76. Specifically, first separating plate 50A includes upper surface 74A and lower surface 76A, and second separating plate 50B includes upper surface 74B and lower surface 76B.

First separating plate 50A of unit 48 includes upper surface 74A and lower surface 76A. Lower surface 76A can be connected to upper radial surface 78 of layer 52L of radial flow circuit 52. Layer 52L of radial flow circuit 52 includes radial fins 52F. Layer 52L can include any number of radial fins 52F. Moreover, the spacing between ones of radial fins 52F can be the same or, in other examples, can vary throughout a respective layer 52L and/or between layers 52L.

Upper radial surface 78 of layer 52L of radial flow circuit 52 can be made up of a plurality of upper flat surfaces of fins 52F. Lower radial surface 80 of layer 52L of radial flow circuit 52 can be made up of a plurality of lower flat surfaces of fins 52F. Upper radial surface 78 and lower radial surface 80 can both extend a partial circumference separated by the wedge-shaped gap that corresponds to header region 35 (shown in FIG. 2A).

Lower radial surface 80 of layer 52L of radial flow circuit 52 can be connected to upper surface 74B of second separating plate 50B. Lower surface 76B of second separating plate 50B can be connected to upper circumferential surface 82 of layer 54L of circumferential flow circuit 54. Layer 54L of circumferential flow circuit 54 includes circumferential fins 54F. Layer 54L can include any number of circumferential fins 54F. Moreover, the spacing between ones of circumferential fins 54F can be the same or, in other examples, can vary throughout a respective layer 54L and/or between layers 54L.

Upper circumferential surface 82 of layer 54L of circumferential flow circuit 54 can be made up of a plurality of upper flat surfaces of fins 54F. Lower circumferential surface 84 of layer 54L of circumferential flow circuit 54 can be made up of a plurality of lower flat surfaces of fins 54F. Upper circumferential surface 82 and lower circumferential surface 84 can both extend a partial circumference separated by the wedge-shaped gap that corresponds to header region 35 (shown in FIG. 2A).

Lower circumferential surface 84 can be connected to upper surface 74A of first separating plate 50A of another unit 48 (not shown) or to end plate 46E (shown in FIG. 2B) in an example where the respective unit 48 is a relatively last unit of core 30. Although the example of FIG. 3 is shown to include, in the following order, first separating plate 50A, layer 52L of radial flow circuit 52, second separating plate 50B, and layer 54L of circumferential flow circuit 54, it should be understood that layer 52L of radial flow circuit 52 is sequentially interchangeable with layer 54L of circumferential flow circuit 54.

FIGS. 4A-4C

Figure 4C:
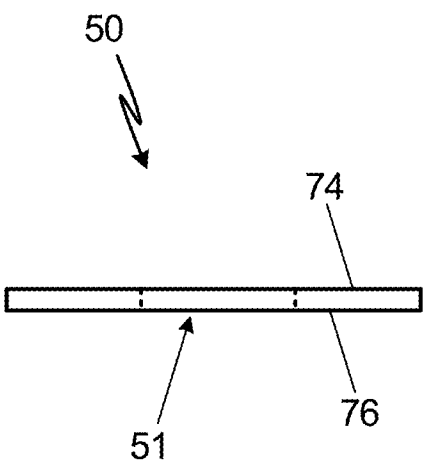
FIG. 4C is a side view of the separating plate.
Figure 4B:
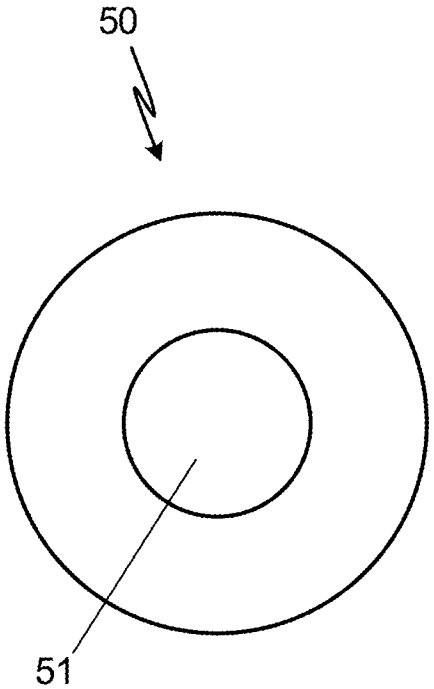
FIG. 4B is a top view of the separating plate.
Figure 4A:
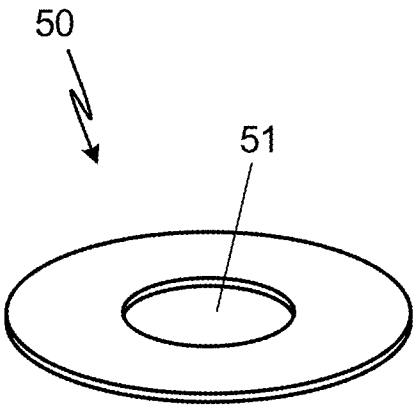
FIG. 4A is an oblique projection view of a separating plate.

For clarity and case of discussion, FIGS. 4A-4C will be described together. FIG. 4A is an oblique projection view of separating plate 50. FIG. 4B is a top view of separating plate 50. FIG. 4C is a side view of separating plate 50. FIGS. 4A-4C show separating plate 50 and opening 51. FIG. 4C further shows upper surface 74 and lower surface 76.

Separating plate 50 can be an annular sheet. In some examples, separating plate 50 is an annular sheet of metal. Opening 51 is the central opening through the annulus of separating plate 50. Consecutive openings 51 (in multiple separating sheets 50) can be aligned to form central bore 28 (shown in FIG. 1A).

In one example, separating plate 50 is a first separating plate 50 of a relatively first unit 48 at first end 44 (shown in FIG. 2A) of core 30. In such an example, upper surface 74 forms or is connected or adjacent to first end 14 of shell 12. Opening 51 can align with the opening of the annular surface of first end 14 of shell 12 such that central bore 28 extends from shell 12 to core 30. Lower surface 76 of separating plate 50 can connect to upper radial surface 78 of layer 52L of radial flow circuit 52 or upper circumferential surface 82 of layer 54L of circumferential flow circuit 54.

In another example, separating plate 50 is positioned between first end 44 and second end 46 of core 30. In such examples, separating plate 50 is positioned between one layer 52L of radial flow circuit 52 and one layer 54L of circumferential flow circuit 54. In some examples, separating plate 50 may be sandwiched between lower radial surface 80 of layer 52L and upper circumferential surface 82 of layer 54L. In other examples, separating plate 50 may be sandwiched between lower circumferential surface 84 of layer 54L and upper radial surface 78 of layer 52L.

FIGS. 5A-5C

Figure 5C:
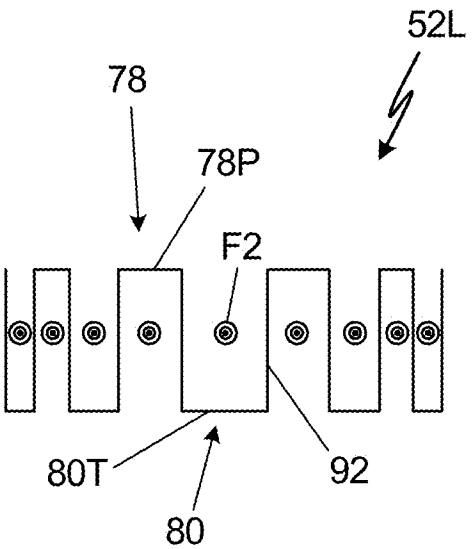
FIG. 5C is a schematic side view of the layer of the radial flow circuit.
Figure 5B:
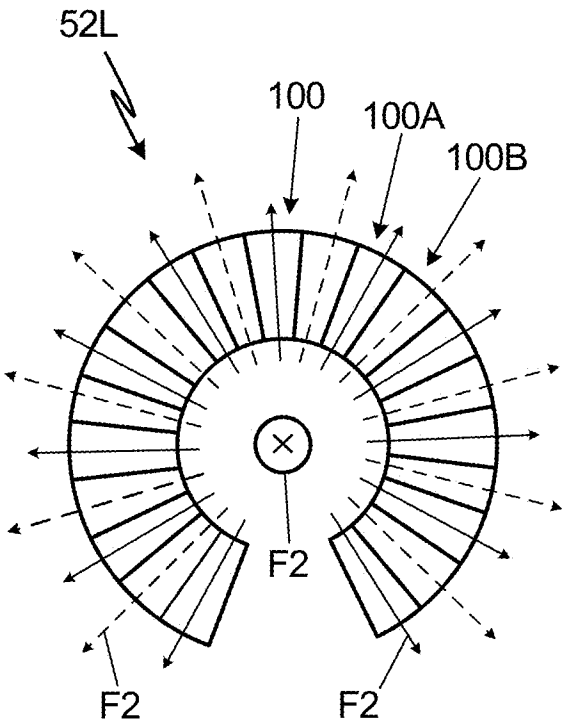
FIG. 5B is a top view of the layer of the radial flow circuit.
Figure 5A:
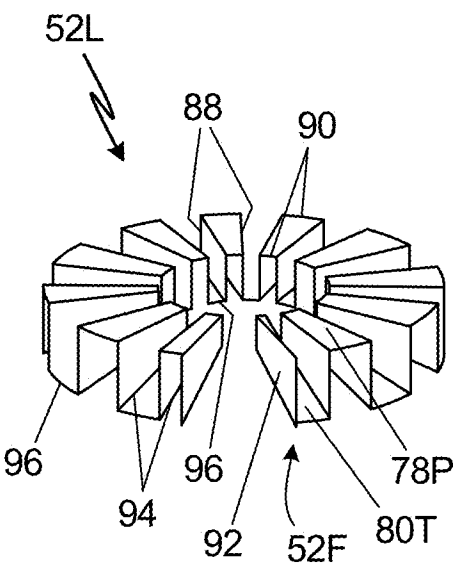
FIG. 5A is an oblique projection view of a layer of a radial flow circuit.

For clarity and case of discussion, FIGS. 5A-5C will be described together. FIG. 5A is an oblique projection view of layer 52L of radial flow circuit 52. FIG. 5B is a top view of layer 52L of radial flow circuit 52. FIG. 5C is a schematic side view of layer 52L of radial flow circuit 52. Layer 52L includes radially extending fins 52F, upper radial surface 78 (including peaks 78P), lower surface 80 (including troughs 80T), upper radially extending edges 88, upper circumferentially extending edges 90, radially extending walls 92, lower radially extending edges 94, lower circumferentially extending edges 96, and flow channels 100 (including flow channels 100A and 100B).

FIGS. 5A-5C show layer 52L. FIGS. 5A and 5C further show peaks 78P, troughs 80T, and radially extending walls 92. FIG. 5A further shows radially extending fins 52F, upper radially extending edges 88, upper circumferentially extending edges 90, lower radially extending edges 94, and lower circumferentially extending edges 96. FIG. 5B further shows flow channels 100 (including flow channels 100A and flow channels 100B). FIG. 5C further shows upper radial surface 78 and lower radial surface 80. FIGS. 5B-5C further show secondary flow pathway F2.

A plurality of radially extending fins 52F of layer 52L of radial flow circuit 52 can define upper radial surface 78 and lower radial surface 80. Upper radial surface 78 is longitudinally opposite to lower radial surface 80 such that upper radial surface 78 can be longitudinally closer to the first end 44 of core 30 than lower radial surface 80. Accordingly, lower radial surface 80 can be longitudinally closer to the second end 46 of core 30 than upper radial surface 78.

Radially extending fins 52F can have peaks 78P that make up upper radial surface 78. Upper radial surface 78 has a perimeter defined by upper radially extending edges 88 and upper circumferentially extending edges 90. Upper radial surface 78 extends radially and can be parallel to first end 44 of core 30 and second end 46 of core 30. Radially extending walls 92 extend from upper radially extending edges 88 to lower radially extending edges 94. Lower radially extending edges 94 join lower circumferentially extending edges 96. Lower radially extending edges 94 and lower circumferentially extending edges 96 collectively define the perimeter of lower radial surface 80. Radially extending fins 52F can have troughs 80T that make up lower radial surface 80. Lower radial surface 80 extends radially and can be parallel to the first end 44 of core 30 and second end 46 of core 30. The spacing (i.e., the width along the circumference of layer 52L) of peaks 78P and troughs 80T can be the same or varied. The schematic side view of FIG. 5C has narrower spacing toward the lateral edges to illustrate the side perspective.

Layer 52L includes flow channels 100A and 100B, which will be referred to collectively herein as "flow channels 100." Flow channels 100 are formed by radially extending fins 52F. Specifically, radially extending walls 92 and upper radial surface 78 can enclose a space extending from inner diameter CD1 to outer diameter CD2 that forms flow channel 100A. Radially extending walls 92 and lower radial surface 80 can enclose a space extending from inner diameter CD1 to outer diameter CD2 that forms flow channel 100B. Flow channels 100 can have a generally rectangular cross-sectional area.

Flow channels 100 define a portion of secondary flow pathway F2. Flow channels 100 extend radially from radial inlets 60 to radial outlets 62 (shown in FIG. 2A). The secondary fluid can enter flow channels 100 through the plurality of radial inlets 60 and travel radially along the length of flow channels 100 along secondary flow pathway F2 in the direction indicated by the arrows in FIGS. 5B-5C. The secondary fluid can exit flow channels 100 from radial outlets 62.

FIGS. 6A-6C

Figure 6C:
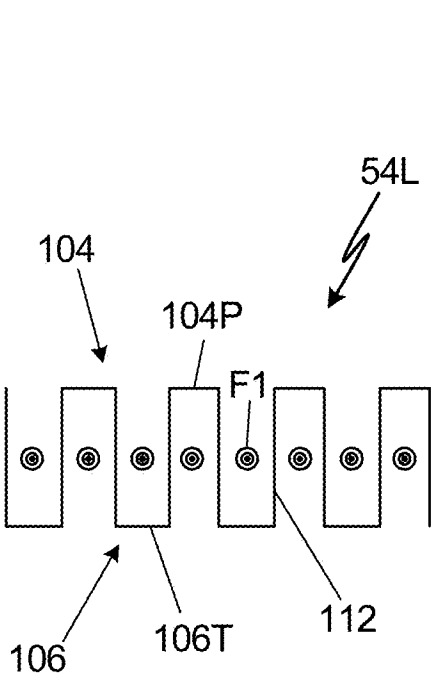
FIG. 6C is a schematic side view of the layer of the circumferential flow circuit at a first end of a header region.
Figure 6B:
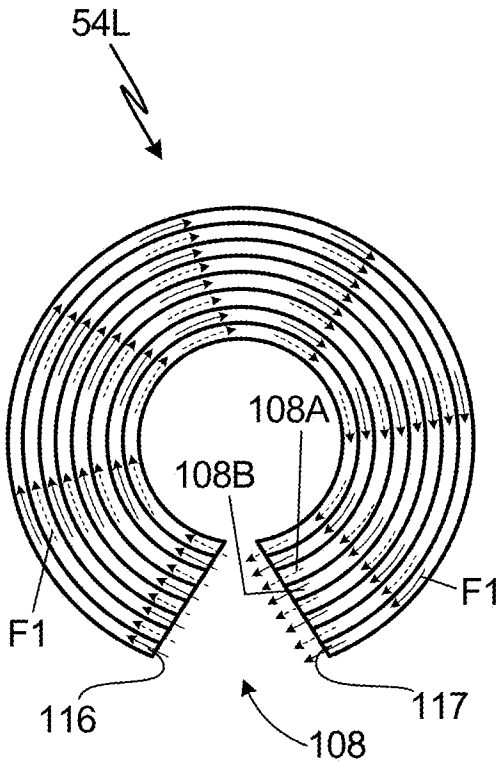
FIG. 6B is a top view of the layer of the circumferential flow circuit.
Figure 6A:
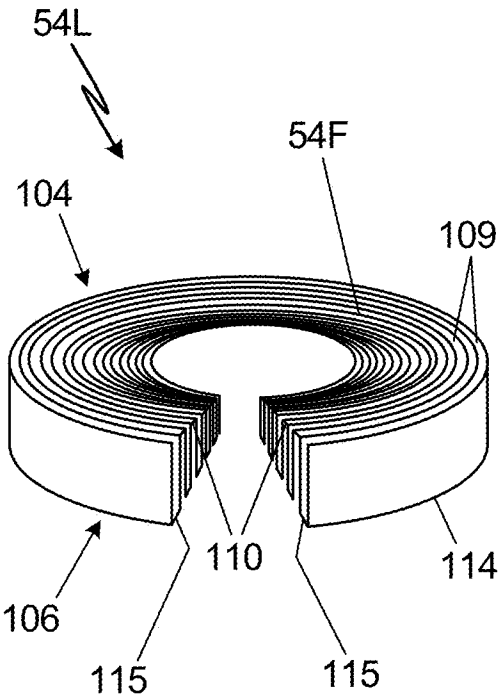
FIG. 6A is an oblique projection view of a layer of a circumferential flow circuit.

For clarity and case of discussion, FIGS. 6A-6C will be described together. FIG. 6A is an oblique projection view of layer 54L of circumferential flow circuit 54. FIG. 6B is a top view of layer 54L of circumferential flow circuit 54. FIG. 6C is a schematic side view of layer 54L of circumferential flow circuit 54 at first end 70 of header region 35. Layer 54L includes circumferentially extending fins 54F, upper circumferential surface 104 (including peaks 104P), lower circumferential surface 106 (including troughs 106T), flow channels 108 (including flow channels 108A and 108B), upper circumferentially extending edges 109, upper radially extending edges 110, circumferentially extending walls 112, lower circumferentially extending edges 114, lower radially extending edges 115, circumferential inlets 116, and circumferential outlets 117.

FIGS. 6A-6C show layer 54L. FIGS. 6A and 6C further show upper circumferential surface 104 and lower circumferential surface 106. FIG. 6A further shows circumferentially extending fins 54F, upper circumferentially extending edges 109, upper radially extending edges 110, lower circumferentially extending edges 114, and lower radially extending edges 115. FIG. 6B further shows flow channels 108 (including flow channels 108A and flow channels 108B), circumferential inlets 116, and circumferential outlets 117. FIG. 6C further shows peaks 104P, circumferentially extending walls 112, and troughs 106T. FIGS. 6B-6C further show primary flow pathway F1.

A plurality of circumferentially extending fins 54F of layer 54L of radial flow circuit 54 can define upper circumferential surface 104 and lower circumferential surface 106. Upper circumferential surface 104 is longitudinally opposite to lower circumferential surface 106 such that upper circumferential surface 104 can be longitudinally closer to first end 44 of core 30 than lower circumferential surface 106. Accordingly, lower circumferential surface 106 can be longitudinally closer to second end 46 of core 30 than upper circumferential surface 104.

Circumferentially extending fins 54F can have peaks 104P that make up upper circumferential surface 104. Upper circumferential surface 104 is a circumferentially extending surface that is defined by a pair of upper circumferentially extending edges 109 and a pair of upper radially extending edges 110. Upper circumferential surface 104 extends circumferentially along a portion of core 30 and can be parallel to first end 44 and second end 46 of core 30. Circumferentially extending walls 112 extend from upper circumferentially extending edges 109 to lower circumferentially extending edges 114. The pair of lower circumferentially extending edges 114 join lower radially extending edges 115. Lower circumferentially extending edges 114 and lower radially extending edges 115 collectively define the perimeter of lower circumferential surface 106. Circumferentially extending fins 54F can have troughs 106T that make up lower circumferential surface 106. Lower circumferential surface 106 extends circumferentially and can be parallel to first end 44 and second end 46 of core 30. The spacing (i.e., the width along the radius of layer 54L) of peaks 104P and troughs 106T can be the same or varied.

Layer 54L includes flow channels 108A and 108B, which will be referred to collectively herein as "flow channels 108." Flow channels 108 are formed by circumferentially extending fins 54F. Specifically, circumferentially extending walls 112 and upper circumferential surface 104 can enclose a space extending a circumferential length of core 30 within a region between inner diameter CD1 of core 30 and outer diameter CD2 of core 30 that forms flow channel 108A. Circumferentially extending walls 112 and lower circumferential surface 106 can enclose a space extending a circumferential length of core 30 within a region between the inner diameter CD1 of core 30 and outer diameter CD2 of core 30 that forms flow channel 108B. Flow channels 108 can have a generally rectangular cross-sectional area.

Flow channels 108 define a portion of primary flow pathway F1. Flow channels 108 extend from circumferential inlets 116 on first end 70 of header region 35 and terminate at circumferential outlets 117. The primary fluid can enter flow channels 108 through circumferential inlets 116 and travel circumferentially along the length of flow channels 108 along primary flow pathway F1 in the direction indicated by the arrows in FIGS. 6B-6C. The primary fluid can exit flow channels 108 from circumferential outlets 117.

Circumferential inlets 116 of layer 54L of circumferential flow circuit 54 can be arranged between inner diameter CD1 and outer diameter CD2 of core 30 along a radial direction of first end 70 (as shown in FIG. 6C). Circumferential inlets 116 can be arranged between first end 44 of core 30 and second end 46 of core 30 along a longitudinal direction of first end 70. In some examples, circumferential inlets 116 are parallel rows of rectangular openings positioned adjacently along the width of first end 70. Each row of rectangular openings can be separated by a parallel longitudinal length of two separating plates 50 and one layer 52L of radial flow circuit 52. The rows can collectively extend the height of first end 70. Each circumferential inlet 116 can open into a respective flow channel 108 of circumferential flow circuit 54. Fluid received by circumferential inlets 116 can travel circumferentially through the respective flow channels 108 before exiting core 30 through circumferential outlets 117 on second end 72 (as indicated in FIG. 6B by the arrows).

Circumferential outlets 117 can be arranged between inner diameter CD1 and outer diameter CD2 of core 30 along a radial direction of second end 72. Although FIG. 6C is a side view of circumferential inlets 116 on a portion of first end 70, it should be understood that the side view of circumferential outlets 117 on a portion of second end 72 is generally the same as the side view shown in FIG. 6C. Circumferential outlets 117 can be arranged between first end 44 of core 30 and second end 46 of core 30 along a longitudinal direction of second end 72. In some examples, circumferential outlets 117 are parallel rows of rectangular openings positioned adjacently along the width of second end 72. Each row of rectangular openings can be separated by a parallel longitudinal length of two separating plates 50 and one layer 52L of radial flow circuit 52. The rows can collectively extend the height of second end 72. Each circumferential outlet 117 can receive fluid from a respective flow channel 108 of circumferential flow circuit 54 and facilitate fluid flow out of core 30 (as indicated in FIG. 6B by the arrows).

FIGS. 1A-6C

Referring to FIGS. 1A-6C together, annular PFHX 10 can be more effective and compact compared to traditional (e.g., rectangular) core heat exchangers. Because core 30 of annular PFHX 10 is annular, central bore 28 can provide a relatively large inlet face for the secondary fluid compared to traditional heat exchangers. Furthermore, the annular configuration can maximize secondary fluid flow intake through secondary flow pathway F2 while also allowing core 30 to be relatively compact. As such, annular PFHX 10 can have up to four times the cooling flow compared to a traditional heat exchanger with the same pressure differential. Increased cooling flow corresponds to increased heat transfer. Likewise, annular PFHX 10 can have a smaller overall size (and decreased weight) and provide comparable heat transfer capabilities to a larger traditional heat exchanger.

Annular PFHX 210A-210H (FIGS. 7A-7H)

Several examples of heat exchangers according to techniques of this disclosure will be described with reference to FIGS. 7A-7H. Each heat exchanger example shown in FIGS. 7A-7H includes generally similar components, which are identified by shared reference numbers that are increased by 200 compared to FIGS. 1A-6C and which include a different reference character for each figure (e.g., FIG. 7A includes annular PFHX 210A, FIG. 7B includes annular PFHX 210B, etc.). Further, each heat exchanger example shown in FIGS. 7A-7H can be an example of annular PFHX 10 (described above in reference to FIGS. 1A-6C), with similar components sharing the same name. For ease of discussion, some components of the heat exchanger examples shown in FIGS. 7A-7H are not described in detail in the following sections, but it should be understood that the heat exchanger examples shown in FIGS. 7A-7H can include all or any combination of the components and features described above with respect to FIGS. 1A-6C. Additionally, although depicted in FIGS. 7A-7H as separate examples, a heat exchanger according to techniques of this disclosure can include any combination of the following features.

FIGS. 7A-7B

For clarity and ease of discussion, FIGS. 7A-7B will be described together. FIG. 7A is a schematic cross-sectional view of annular PFHX 210A showing core 230A including flow directing structure 318. FIG. 7B is a schematic cross-sectional view of annular PFHX 210B showing core 230B including flow directing structure 318. FIG. 7A shows annular PFHX 210A, shell 212A, exhaust tube 226A, central bore 228A, core 230A (including first end 244A and second end 246A), secondary flow pathway F2B, inner diameter CD1A, inner surface 240A, and flow directing structure 318A. FIG. 7B shows annular PFHX 210B, shell 212B, exhaust tube 226B, central bore 228B, core 230B (including first end 244B and second end 246B), secondary flow pathway F2B, inner diameter CD1B, inner surface 240B, and flow directing structure 318B, which includes central base 320, first main body 322, changing diameter 324, first vertex 326, second vertex 328, and second main body 330.

Annular PFHX 210A and annular PFHX 210B can include generally the same structure and function as annular PFHX 10 (FIGS. 1A-6C), except annular PFHX 210A and annular PFHX 210B include open second end 246A, 246B of core 230A, 230B and flow directing structure 318. Second end 246A, 246B of core 230A, 230B can be an annular surface with an opening. Annular PFHX 210A and annular PFHX 210B each further include flow directing structure 318. Flow directing structure 318 can be positioned within central bore 228A, 228B. Inner surface 240A, 240B of core 230A, 230B can surround flow directing structure 318. In some examples, flow directing structure 318 is a three-dimensional geometric shape having a region that connects to inner surface 240A, 240B.

FIG. 7A

Referring now to FIG. 7A, annular PFHX 210A can include flow directing structure 318 that is dividing plate 318A. Dividing plate 318A can be positioned at a region between first end 244A and second end 246A of core 230A. In some examples, dividing plate 318A is positioned at a region equidistant from first end 244A of core 230A and second end 246A of core 230A. For example, dividing plate 318A can be circular and so can extend circumferentially about longitudinal axis A and connect to inner surface 240A of core 230A along its circumference. Dividing plate 318A can have a diameter that is equal to the inner diameter CD1A of core 230A and spatially divide central bore 228A, for example, into equivalent halves.

The secondary fluid can enter core 230A through first end 244A. The secondary fluid can flow longitudinally through central bore 228A toward second end 246A and then divert radially through radial flow channels of core 230A. Some of the secondary fluid can continue longitudinally and contact dividing plate 318A. Dividing plate 318A can then radially redirect the secondary fluid into the radial flow channels of core 230A. The secondary fluid can also enter core 230A through second end 246A. The secondary fluid can flow longitudinally through central bore 228A toward first end 244A and then divert radially through radial flow channels of core 230A. Some of the secondary fluid can continue longitudinally and contact dividing plate 318A. Dividing plate 318A can then radially redirect the secondary fluid into the radial flow channels of core 230A.

As described with respect to FIG. 7A, dividing plate 318A can prevent the secondary fluid from flowing directly through central bore 228A from first end 244A to second end 246A or from second end 246A to first end 244A of core 230A. This configuration can allow the secondary fluid to be received from both ends of annular PFHX 210A and facilitate distribution of the secondary fluid into the radial flow channels of core 230A before the secondary fluid travels the entire length of core 230A. This can allow annular PFHX 210A to receive a higher flow volume of the secondary fluid and to more efficiently distribute the secondary fluid into core 230A. Accordingly, this configuration can allow for annular PFHX 210A to have increased fluid flow distribution compared to traditional annular heat exchanger configurations.

FIG. 7B

Referring now to FIG. 7B, annular PFHX 210B can have generally the same configuration as described with respect to FIG. 7A, except in this example flow redirecting structure 318 is double cone 318B. Double cone 318B can have circular central base 320 that is connected to inner surface 240B of core 230B. In some examples, central base 320 is connected circumferentially to inner surface 240B. Central base 320 can have a diameter that is equal to inner diameter CD1B of core 230B and can spatially divide central bore 228B, for example, into two equivalent halves. Central base 320 can extend towards first end 244B of core 230B to form first main body 322. Central base 320 can also extend towards second end 246B of core 230B to form second main body 330.

First main body 322 and second main body 330 are defined by changing diameter 324 that decreases as first main body 322 extends towards first end 244B and second main body 330 extends towards second end 246B of core 230B. First main body 322 tapers and converges at first vertex 326. Second main body 330 tapers and converges at second vertex 328. First vertex 326 is located longitudinally opposite to second vertex 328. Changing diameter 324 can be greatest at central base 320 and decrease to be smallest at both first vertex 326 and second vertex 328. First vertex 326 and second vertex 328 can each be a point or a rounded point of first main body 322 and second main body 330, respectively. First vertex 326 and second vertex 328 can be centered on a longitudinal axis through annular PFHX 210B.

Double cone 318B can redirect the secondary fluid that enters core 230B at first end 244B and second end 246B. For example, the secondary fluid entering from first end 244B can interact with double cone 318B at first vertex 326 such that the secondary fluid is redirected around first vertex 326 to travel along first main body 322 and be directed toward inner surface 240B of core 230B as the secondary fluid travels longitudinally towards second end 246B. The gradual increase of changing diameter 324 can direct the secondary fluid in a radial direction such that the secondary fluid enters the radial flow channels of core 230B. Likewise, the secondary fluid entering from second end 246B can interact with double cone 318B at second vertex 328 such that the secondary fluid is redirected around second vertex 328 to travel along second main body 330 and be directed toward inner surface 240B of core 230B as the secondary fluid travels longitudinally towards first end 244B. The gradual increase of changing diameter 324 can direct the secondary fluid in a radial direction such that the secondary fluid enters the radial flow channels of core 230B.

As described with respect to FIG. 7B, this configuration can cause the secondary fluid to be distributed into the radial flow channels of core 230B at angles less than 90 degrees (or not perpendicularly) with respect to a longitudinal axis through annular PFHX 210B. This can allow the secondary fluid to travel in a generally longitudinal direction without abrupt redirection into core 230B. Furthermore, double cone 318B can prevent the secondary fluid from flowing directly through central bore 228B from first end 244B to second end 246B or from second end 246B to first end 244B of core 230B. This configuration can allow the secondary fluid to be received from both ends of annular PFHX 210B and can facilitate distribution of the secondary fluid into the radial flow channels of core 230B before the secondary fluid travels the entire length of core 230B. This can allow annular PFHX 210B to receive a higher flow volume of the secondary fluid and more efficiently distribute the secondary fluid into core 230B. Accordingly, this configuration can allow for annular PFHX 210B to have increased fluid flow distribution compared to traditional annular heat exchanger configurations.

FIG. 7C

FIG. 7C is a schematic cross-sectional view of annular PFHX 210C showing shell 212C. FIG. 7C shows annular PFHX 210C, shell 212C (including first end 214C, second end 222C, and shell body 220C), exhaust tube 226C, central bore 228C, core 230C, and secondary flow pathway F2C.

Annular PFHX 210C can include generally the same structure and function as annular PFHX 210A (FIG. 7A), except exhaust tube 226C is positioned on shell body 220C of shell 212C rather than on an end of shell 212C. Exhaust tube 226C can be positioned anywhere between first end 214C and second end 222C of shell 212C. In one example, exhaust tube 226C is positioned equidistantly between first end 214C and second end 222C of shell 212C.

In operation, the secondary fluid can enter core 230C through first end 244C and second end 246C. The secondary fluid can flow longitudinally through central bore 228C and then divert radially through radial flow channels of core 230C. The secondary fluid can exit core 230C into shell 212C. The secondary fluid can travel longitudinally and circumferentially to exhaust tube 226C, where the secondary fluid can exit annular PFHX 210C from exhaust tube 226C.

Shell 212C including exhaust tube 226C positioned on shell body 220C rather than an end provides another option for connecting annular PFHX 210C to external ducting or other downstream components compared to annular PFHX 10 (shown in FIGS. 1A-6C).

FIG. 7D

FIG. 7D is a schematic cross-sectional view of annular PFHX 210D showing shell 212D. FIG. 7D shows annular PFHX 210D, shell 212D (including first end 214D and second end 222D), central bore 228D, core 230D (including first end 244D and second end 246D), secondary flow pathway F2D, and flow directing structure 318D.

Annular PFHX 210D can include generally the same structure and function as annular PFHX 210A (FIG. 7A), except annular PFHX 210D may not include an exhaust bore or an exhaust tube. Flow directing structure 318D divides central bore 228D. In some examples, flow directing structure 318D can be a circular dividing plate. In other examples, flow directing structure 318D can be a double cone. The direction of flow of the secondary fluid radially through core 230D can change on either side of flow directing structure 318D.

The secondary fluid can enter core 230D through first end 244D. The secondary fluid can flow longitudinally through central bore 228D toward second end 246D and then divert radially through radial flow channels of core 230D. Some of the secondary fluid can continue longitudinally and contact flow directing structure 318D. Flow directing structure 318D can then radially redirect the secondary fluid into the radial flow channels of core 230D. The secondary fluid can exit core 230D into shell 212D. The secondary fluid can flow within shell 212D and travel longitudinally towards second end 222D, then divert radially back through the radial flow channels of core 230D into central bore 228D on the other side of flow directing structure 318D. That is, openings of radial flow channels of core 230D that are configured as radial outlets in the example shown in FIG. 1C but that are located closer to second end 222D with respect to flow directing structure 318D function as inlets for the secondary fluid in this example. Likewise, openings of radial flow channels of core 230D that are configured as radial inlets in the example shown in FIG. 1C but that are located closer to second end 222D with respect to flow directing structure 318D function as outlets for the secondary fluid in this example. The secondary fluid can exit both core 230D and annular PFHX 210D through an opening of annular second end 222D.

Accordingly, annular PFHX 210D can accommodate flow that enters and exits through central bore 228D, which provides another option for arrangement of annular PFHX 210D with respect to other downstream components compared to annular PFHX 10 (shown in FIGS. 1A-6C).

FIG. 7E

FIG. 7E is a schematic cross-sectional view of annular PFHX 210E showing core 230E including flow directing structure 318. FIG. 7E shows annular PFHX 210E, shell 212E, central bore 228E, core 230E, secondary flow pathway F2E, inner diameter CD1E, first end 244E, second end 246E, and flow directing structure 318E, which includes circular base 332, main body 334, changing diameter 336, and vertex 338.

Annular PFHX 210E can include generally the same structure and function as annular PFHX 10 (FIGS. 1A-6C), except core 230E includes flow directing structure 318 at second end 246E of core 230E. As shown in FIG. 7E, flow directing structure 318 is cone 318E. Cone 318E can include circular base 332 that is connected at second end 246E of core 230E. Main body 334 of cone 318E can extend inward from circular base 332 into central bore 228E. In some examples, circular base 332 has a diameter that is equal to inner diameter CD1E of core 230E. In other examples, circular base 332 has a diameter that is less than inner diameter CD1E of core 230E.

Main body 334 can be centered about a longitudinal axis through core 230E and extend towards first end 244E of core 230E. Main body 334 is defined by changing diameter 336 that decreases as main body 334 extends towards first end 244E of core 230E. Changing diameter 336 can be the smallest at vertex 338, which is located longitudinally opposite to circular base 332. Vertex 338 can be a point or a rounded point of main body 334. Vertex 338 can be centered on a longitudinal axis through annular PFHX 210E.

Cone 318E can redirect the secondary fluid that enters core 230E. For example, the secondary fluid can interact with cone 318E initially at vertex 338. The secondary fluid can be directed around vertex 338 to travel along main body 334 and be directed toward inner surface 240E of core 230E as the secondary fluid travels longitudinally towards second end 222E. The gradual increase of changing diameter 336 can direct the secondary fluid in a radial direction such that the secondary fluid enters the radial flow channels of core 230E. This configuration can cause the secondary fluid to be distributed into the radial flow channels of core 230E at angles less than 90 degrees (or not perpendicularly) with respect to a longitudinal axis through annular PFHX 210E. This can allow the secondary fluid to travel in a generally longitudinal direction without abrupt redirection into core 230E. Accordingly, this configuration can allow for annular PFHX 210E to have increased fluid flow distribution compared to traditional annular heat exchanger configurations.

FIGS. 7F-H

For clarity and case of discussion, FIGS. 7F-7H will be described together. FIG. 7F is a schematic cross-sectional view of annular PFHX 210F showing tapered core 230F. FIG. 7G is a schematic cross-sectional view of annular PFHX 210G showing tapered core 230G. FIG. 7H is a schematic cross-sectional view of annular PFHX 210H showing tapered core 230H. FIG. 7F shows annular PFHX 210F, shell 212F, central bore 228F, tapered core 230F, secondary flow pathway F2F, inner diameter CD1F, outer diameter CD2F, inner surface 240F, first end 244F, and second end 246F. FIG. 7G shows annular PFHX 210G, shell 212G, central bore 228G, tapered core 230G, secondary flow pathway F2G, inner diameter CD1G, outer diameter CD2G, first end 244G, second end 246G, and sections 340A-340*n*. FIG. 7H shows annular PFHX 210H, shell 212H, central bore 228H, tapered core 230H, secondary flow pathway F2H, inner diameter CD1H, outer diameter CD2H, first end 244H, second end 246H, and sections 344A-344*n*.

Annular PFHX 210F, 210G, 210H can each include generally the same structure and function as annular PFHX 10 (FIGS. 1A-6C), except each includes inner diameter CD1F, CD1G, CD1H of tapered core 230F, 230G, 230H that changes along the length of the heat exchanger. In some examples, inner diameter CD1F, CD1G, CD1H decreases from first end 244F, 244G, 244H to second end 246F, 246G, 246H, such that central bore 228F, 228G, 228H tapers (i.e., decreases) from first end 244F, 244G, 244H to second end 246F, 246G, 246H. Annular PFHX 210F, 210G, 210H each further include outer diameter CD2F, CD2G, CD2H of tapered core 230F, 230G, 230H. In some examples, the outer diameter is constant. In other examples, the outer diameter changes, for example, such that the outer diameter decreases proportionally to changing inner diameter CD1F, CD1G, CD1H.

FIG. 7F

Referring now to FIG. 7F, annular PFHX 210F includes tapered core 230F. Tapered core 230F is annular but has a three-dimensional cone shape. Inner diameter CD1F can decrease from first end 244F to second end 246F. In some examples, outer diameter CD2F decreases proportionally with inner diameter CD1F from first end 244F to second end 246F. Accordingly, inner surface 240F of tapered core 230F can taper towards longitudinal axis A such that inner surface 240F is not parallel to longitudinal axis A. In some examples, inner surface 240F can have a continuous or smooth taper from first end 244F to second end 246F. The radial flow channels of tapered core 230F can be correspondingly angled with respect to longitudinal axis A. This tapered configuration can allow the secondary fluid to be distributed into the radial flow channels of tapered core 230F at angles less than 90 degrees (or not perpendicularly) with respect to longitudinal axis A in a direction towards second end 246F of tapered core 230F. This can allow the secondary fluid to travel in a generally longitudinal direction without substantial or abrupt turning to enter tapered core 230F. Accordingly, this configuration can allow for annular PFHX 210F to have increased fluid flow distribution compared to traditional annular heat exchanger configurations.

FIG. 7G

Referring now to FIG. 7G, annular PFHX 210G includes tapered core 230G. Tapered core 230G is divided longitudinally into sections 340A-340*n* (where "n" is an arbitrary positive integer greater than 1). Section 340A can be located at first end 244G and section 340*n* can be located at second end 246G. Although five sections 340A-340*n* are illustrated in FIG. 7G, other examples can include any number of sections 340A-340*n*, including more or fewer than five sections.

A radial height, as measured from inner diameter CD1G to outer diameter CD2G, of each of sections 340A-340*n* can increase between consecutive sections moving longitudinally from first end 244G towards second end 246G. That is, section 340A can be the shortest, and section 340*n* can be the tallest. Accordingly, inner diameter CD1G can be greatest at first end 244G and smallest at second end 246G. As shown in FIG. 7G, outer diameter CD2G can be constant from first end 244G to second end 246G. The incremental tapering of inner diameter CD1G can direct the secondary fluid into the radial flow channels of core 230G. Like annular PFHX 210F (shown in FIG. 7F), this tapered configuration can allow for annular PFHX 210G to have increased fluid flow distribution compared to traditional annular heat exchanger configurations. The tapering of tapered core 230G may also be relatively simple to manufacture due to sections 340A-340*n*.

FIG. 7H

Referring now to FIG. 7H, annular PFHX 210H includes tapered core 230H. Tapered core 230H can include generally the same structure and function as tapered core 230G (shown in FIG. 7G), except tapered core 230H includes staggered sections 344A-344*n* with radial heights that are the same or about the same. Tapered core 230H can be divided longitudinally into sections 344A-344*n*, with section 344A located at first end 244H and section 344*n* located at second end 246H. Although five sections 344A-344*n* are illustrated in FIG. 7H, other examples can include any number of sections 344A-344*n*, including more or fewer than five sections.

Sections 344A-344*n* can generally have about the same radial height as measured from inner diameter CD1H to outer diameter CD2H. However, consecutive ones of sections 344A-344*n* can be staggered moving longitudinally from first end 244H towards second end 246H. That is, section 344A can be positioned radially the farthest away from a longitudinal axis through annular PFHX 210H, and section 344*n* can be positioned radially closest to the longitudinal axis. Accordingly, inner diameter CD1H can be greatest at first end 244H and smallest at second end 246H. Likewise, outer diameter CD2H can also be greatest at first end 244H and smallest at second end 246H. Both inner diameter CD1H and outer diameter CD2H can change along the length of annular PFHX 210H, and, in some examples, the change can be proportional, such that the radial height of sections 344A-344*n* remains constant from first end 244H to second end 246H. The incremental decrease of inner diameter CD1H can direct the secondary fluid into the radial flow channels of core 230H. Like annular PFHX 210F (shown in FIG. 7F) and annular PFHX 210G (shown in FIG. 7G), this tapered configuration can allow for annular PFHX 210H to have increased fluid flow distribution compared to traditional annular heat exchanger configurations. The tapering of tapered core 230H may also be relatively simple to manufacture due to sections 344A-344*n*.

FIGS. 7A-7H are described as separate examples, however it should be understood that an annular PFHX according to the techniques of this disclosure can include all or any combination of the features described in FIGS. 7A-7H.

Annular PFHX 410 (FIGS. 8A-8B)

FIGS. 8A-8B show an example of annular PFHX 10 (shown in FIGS. 1A-6C) and/or annular PFHX 210A-210H (shown in FIGS. 7A-7H), with similar components sharing the same name. Each similar component is identified by shared reference numbers that are incremented by four hundred compared to reference numerals associated with FIGS. 1A-6C. For case of discussion, some components of the annular PFHX example shown in FIGS. 8A-8B are not described in detail in the following section, but it should be understood that the annular PFHX shown in FIGS. 8A-8B can include all or any combination of the components and features described with respect to FIGS. 1A-7H.

For clarity and ease of discussion, FIGS. 8A-8B will be described together. FIG. 8A is a schematic side view of annular PFHX 410 including cross-over manifold 540. FIG. 8B is a schematic cross-sectional top view of annular PFHX 410 taken at line 8B-8B of FIG. 8A. PFHX 410 includes core 430 (including header region 435, first end 444 and second end 446), circumferential flow circuit 454 (including layer 454L, flow channels 508, circumferential inlets 516, and circumferential outlets 517), cross-over manifold 540 (including inlet manifold 542, inlet tubes 544, receiving tube 546, outlet manifold 548, outlet tubes 550, and delivering tube 552). Header region 435 further includes first end 470 and second end 472.

FIGS. 8A-8B show cross-over manifold 540, including inlet manifold 542, inlet tubes 544, outlet manifold 548, and outlet tubes 550. FIG. 8A further shows annular PFHX 410, core 430 (including first end 444 and second end 446), header region 468 (including first end 470 and second end 472), receiving tube 546, delivering tube 552, and longitudinal axis A. FIG. 8B further shows circumferential flow circuit 454, layer 454L, circumferential flow channels 508, circumferential inlets 515, and circumferential outlets 517.

Cross-over manifold 540 is shown as an exaggerated schematic in FIG. 8A to illustrate the components. Cross-over manifold 540 can include inlet manifold 542 and outlet manifold 548. Inlet manifold 542 can connect to first end 470 of header region 435, and outlet manifold 548 can connect to second end 472 of header region 435. Inlet manifold 542 can be configured to receive fluid from another component and deliver fluid into circumferential flow channels 508 through first end 470 of header region 435. The primary fluid can flow circumferentially through flow channels 508 and exit flow channels 508 through second end 472 of header region 435. Outlet manifold 548 can connect to second end 472 of header region 435 and can receive fluid from flow channels 508. Outlet manifold 548 can be configured to deliver fluid from flow channels 508 into other components.

Inlet manifold 542 can be a longitudinally extending body that extends along an exterior of core 430. Inlet manifold 542 may be generally parallel to longitudinal axis A. Inlet manifold 542 can extend from first end 444 to second end 446 of core 430. In some examples, inlet manifold 542 is a tubular body. In other examples, inlet manifold is a three-dimensional rectangular body. In some examples, inlet manifold 542 is enclosed by a shell that surrounds core 430. In other examples, inlet manifold 542 is an integrated portion of a shell.

Inlet manifold 542 can branch into a plurality of inlet tubes 544. Inlet tubes 544 can stack longitudinally between first end 444 and second end 446 of core 430. As shown in FIG. 8B, inlet tubes 544 can extend from and connect inlet manifold 542 to circumferential inlets 516 of one layer 454L of circumferential flow circuit 454. In some examples, inlet tubes 544 are substantially flat tubes that surround all circumferential inlets 516 of a respective layer 454L of circumferential flow circuit 454. Each inlet tube 544 can be connected to a different layer 454L of circumferential flow circuit 454. In some examples, inlet tubes 544 are straight tubes that extend about perpendicular to longitudinal axis A. In other examples, inlet tubes 544 are curved. In some examples, inlet tubes 544 extend tangentially to the annulus of core 430.

Receiving tube 546 can be connected to and in fluid communication with inlet manifold 542. Receiving tube 546 can be configured to receive the primary fluid (e.g., from another component). The primary fluid can flow from receiving tube 546 into inlet manifold 542. The primary fluid can then enter inlet tubes 544 via circumferential inlets 516. The primary fluid can travel circumferentially through each circumferential flow channel 508 before exiting through outlet manifold 548.

Outlet manifold 548 can be a longitudinally extending body that extends along an exterior of core 430. Outlet manifold 548 may be generally parallel to longitudinal axis A. Outlet manifold 548 can extend from first end 444 to second end 446 of core 430. In some examples, outlet manifold 548 is a tubular body. In other examples, outlet manifold is a three-dimensional rectangular body. In some examples, outlet manifold 548 is enclosed by a shell that surrounds core 430. In other examples, outlet manifold 548 is an integrated portion of a shell.

Outlet manifold 548 can branch into a plurality of outlet tubes 550. Outlet tubes 550 can stack longitudinally between first end 444 and second end 446 of core 430. As shown in FIG. 8B, outlet tubes 550 can extend from and connect outlet manifold 548 to circumferential outlets 517 of one layer 454L of circumferential flow circuit 454. In some examples, outlet tubes 550 are substantially flat tubes that surround all circumferential outlets 517 of a respective layer 454L of circumferential flow circuit 454. Each outlet tube 550 can be connected to a different layer 454L of circumferential flow circuit 454. In some examples, outlet tubes 550 are straight tubes that extend about perpendicular to longitudinal axis A. In other examples, outlet tubes 550 are curved. In some examples, outlet tubes 550 extend tangentially to the annulus of core 430.

Delivering tube 552 can be connected to and in fluid communication with outlet manifold 548. Delivering tube 552 can be configured to discharge the primary fluid from core 430 (e.g., to other components). The primary fluid can flow out of circumferential outlets 517 and flow through outlet tubes 550 into outlet manifold 548. The primary fluid can flow out of outlet manifold 548 through delivering tube 552.

As shown in FIGS. 8A-8B, inlet tubes 544 can be interleaved with outlet tubes 550. In some examples, one inlet tube 544 directly overlaps a corresponding outlet tube 550 to form an inlet/outlet pair that corresponds to one layer 454L of circumferential flow circuit 454. In an example, inlet tube 544 is a straight tube, and the paired outlet tube 550 has a curved region that overlaps or crosses over inlet tube 544. In another example, inlet tube 544 has a curved portion that overlaps or crosses over a straight outlet tube 550. In yet another example, both inlet tube 544 and outlet tube 550 have overlapping curved portions. These configurations can allow inlet tubes 544 and outlet tubes 550 to respectively reach circumferential inlets 516 and circumferential outlets 517 of the same layer 454L of circumferential flow circuit 454 without extending into portions of header region 435 associated with other layers of circumferential flow circuit 454 or blocking other flow paths.

More specifically, as shown in FIG. 8B, inlet tube 544 can extend at an angle from inlet manifold 542 that allows inlet tube 544 to connect approximately in line with circumferential flow channels 508 at circumferential inlets 516. Similarly, outlet tube 550 can extend at an angle from outlet manifold 548 that allows outlet tube 550 to connect approximately in line with circumferential flow channels 508 at circumferential outlets 517. Inlet manifold 542, including inlet tubes 544, can allow the primary fluid to flow smoothly into circumferential inlets 516 without substantial redirection. Outlet manifold 548, including outlet tubes 550, can allow the primary fluid to flow smoothly out of circumferential outlets 517 without substantial redirection to exit annular PFHX 410. Accordingly, this configuration can reduce pressure losses (e.g., turning losses due to sharp bends, etc.) in the manifold region of annular PFHX 410 so annular PFHX 410 can be more effective compared to traditional annular heat exchanger configurations.

Heat Exchange System 600 (FIG. 9)

FIG. 9 is an oblique projection view of annular heat exchange system 600 showing annular PFHX 610 and fan 754. Annular PFHX 610 includes central bore 628, core 630 (including inner surface 640, first end 644, and second end 646). Fan 754 includes blades 755. FIG. 9 further shows longitudinal axis A.

Annular PFHX 610 can include all or any combination of the components or features described above with respect to FIGS. 1A-8B, with similar components sharing the same name. Each similar component is identified by shared reference numbers that are incremented by six hundred compared to reference numerals associated with FIGS. 1A-6C. For ease of discussion, some components of annular PFHX 610 are not described in detail in the following section, but it should be understood that annular PFHX 610 can include all or any combination of the components and features described with respect to FIGS. 1A-8B.

As shown in FIG. 9, annular heat exchange system 600 includes annular PFHX 610 and fan 754. Fan 754 can be positioned within the annulus of annular PFHX 610 such that fan 754 is surrounded by core 630. Fan 754 can have a plurality of blades 755 that extend radially from longitudinal axis A towards inner surface 640 of core 630. Fan 754 can include any suitable number of blades 755. In some examples, fan 754 is coupled to first end 644 of core 630. In other examples, fan 754 is coupled to inner surface 640 at any suitable location between first end 644 and second end 646.

Fan 754 can be configured to increase fluid flow into annular PFHX 610 by driving the secondary fluid into core 630 through central bore 628. In some examples, fan 754 drives the secondary fluid into core 630 by rotating circumferentially within core 630. The position of fan 754 driving the secondary fluid into core 630 can increase both the fluid flow and the uniformity of fluid flow into core 630. Accordingly, annular heat exchange system 600 can improve fluid flow distribution by increasing fluid flow into core 630 for improved heat transfer. Furthermore, fan 754 may not take up additional space beyond the profile of annular PFHX 610.

Accordingly, annular heat exchange system 600 can be more compact and efficient compared to traditional heat exchange systems.

Discussion of Possible Embodiments

The following are non-exclusive descriptions of possible embodiments of the present invention.

A heat exchanger includes an exhaust shell and an annular core contained within the exhaust shell. The annular core includes a first end, a second end that is axially opposite to the first end, an outer diameter defining an outer surface, and an inner diameter defining an inner surface. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold comprising a second inlet and a first outlet manifold fluidly connected to the first inlet manifold, the first outlet manifold comprising a second outlet. The second inlet branches into a first set of tubes that connect to the second set of layers at a first region. The second outlet branches into a second set of tubes that connect to the second set of layers at a second region. The annular core further includes a plurality of plates separating the first set of layers and the second set of layers.

The heat exchanger of the preceding paragraph can optionally include, additionally and/or alternatively, any one or more of the following features, configurations and/or additional components:

The first direction can be a radial direction, and the second direction can be a circumferential direction.

The annular core can include alternating layers, and the alternating layers can alternate between a layer of the first set of layers and a layer of the second set of layers.

The first set of tubes of the second inlet can overlap the second set of tubes of the second outlet.

The first end of the annular core can be open, the second end of the annular core can be closed, and the second end of the annular core can include a cone. The cone can include a curved surface and a vertex at an end of the curved surface, and the vertex can extend towards the first end of the annular core.

The first end of the annular core can be open, the second end of the annular core can be open, and the inner surface can further include a flow directing feature spanning the inner diameter at a region between the first end and the second end of the annular core.

The flow directing feature can be a dividing plate.

The flow directing feature can a double-cone configuration, and the double-cone configuration can further include a base having a diameter that fits within the inner diameter; a first vertex, and the first vertex can extend towards the first end of the annular core; and a second vertex, and the second vertex can extend towards the second end of the annular core.

Each fin of the first plurality of fins and the second plurality of fins can be sandwiched between two plates of the plurality of plates.

The heat exchanger can further include an exhaust tube connected to the exhaust shell.

A heat exchanger includes an exhaust shell and an annular core contained within the exhaust shell. The annular core includes a first end, a second end that is axially opposite to the first end, an outer diameter defining an outer surface, and inner diameter defining an inner surface. The inner diameter changes from the first end to the second end. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold and a first outlet manifold fluidly connected to the first inlet manifold. The annular core further includes a plurality of plates separating the first set of layers from the second set of layers.

The heat exchanger of the preceding paragraph can optionally include, additionally and/or alternatively, any one or more of the following features, configurations and/or additional components:

The first direction can be a radial direction, and the second direction can be a circumferential direction.

The second end of the annular core can include a cone, and the cone can further include a curved surface and a vertex at an end of the curved surface, and the vertex can extend towards the first end of the annular core.

The first end of the annular core can be open, the second end of the annular core can be open, and the inner surface can further include a flow directing feature spanning the inner diameter at a region between the first end and the second end of the annular core. The flow directing feature can be either a dividing plate or a double-cone configuration.

The annular core can be tapered.

The inner diameter and the outer diameter can decrease proportionally from the first end to the second end of the annular core.

The annular core can be divided longitudinally into staggered sections that each have a same radial height.

The annular core can be divided longitudinally into sections that have increasing radial heights between consecutive sections from the first end to the second end of the annular core.

A heat exchange system includes a heat exchanger and a fan that is positioned within an annular core of the heat exchanger. The heat exchanger includes an exhaust shell, an annular core contained within the exhaust shell, and an exhaust tube connected to the exhaust shell. The annular core includes a first end; a second end axially opposite to the first end; an outer diameter extending between the first end and the second end, the outer diameter defining an outer surface; and an inner diameter extending between the first and the second end, the inner diameter defining an inner surface. The annular core further includes a first plurality of fins extending in a first direction between the inner diameter and the outer diameter in a first set of layers. The first plurality of fins further includes a first inlet and a first outlet fluidly connected to the first inlet. The annular core further includes a second plurality of fins extending in a second direction between the inner diameter and the outer diameter in a second set of layers. The second plurality of fins further includes a first inlet manifold and a first outlet manifold fluidly connected to the first inlet manifold. The first inlet manifold includes a second inlet, and the second inlet branches into a first set of tubes that connect to the second set of layers at a first region. The first outlet manifold includes a second outlet, and the second outlet branches into a second set of tubes that connect to the second set of layers at a second region. The annular core further includes a plurality of plates separating the first set of layers and the second set of layers.

The heat exchange system of the preceding paragraph can optionally include, additionally and/or alternatively, any one or more of the following features, configurations and/or additional components:

Blades of the fan can extend radially to the inner surface of the annular core.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:
an exhaust shell;
an annular core contained within the exhaust shell, the annular core comprising:
a first end;
a second end that is axially opposite to the first end;
an outer diameter defining an outer surface;
an inner diameter defining an inner surface;
a first plurality of fins extending in a first direction between the inner diameter and the outer diameter in a first set of layers, the first plurality of fins further comprising:
a first inlet; and
a first outlet fluidly connected to the first inlet;
a second plurality of fins extending in a second direction between the inner diameter and the outer diameter in a second set of layers, the second plurality of fins further comprising:
a first inlet manifold comprising:
a second inlet, wherein the second inlet branches into a first set of tubes that connect to the second set of layers at a first region; and
a first outlet manifold fluidly connected to the first inlet manifold, the first outlet manifold comprising:
a second outlet, wherein the second outlet branches into a second set of tubes that connect to the second set of layers at a second region; and
a plurality of plates separating the first set of layers and the second set of layers.

2. The heat exchanger of claim 1, wherein the first direction is a radial direction, and wherein the second direction is a circumferential direction.

3. The heat exchanger of claim 1, wherein the annular core includes alternating layers, wherein the alternating layers alternate between a layer of the first set of layers and a layer of the second set of layers.

4. The heat exchanger of claim 1, wherein the first set of tubes of the second inlet overlaps the second set of tubes of the second outlet.

5. The heat exchanger of claim 1, wherein the first end of the annular core is open, wherein the second end of the annular core is closed, and wherein the second end of the annular core includes a cone, the cone further comprising:
a curved surface; and
a vertex at an end of the curved surface, wherein the vertex extends towards the first end of the annular core.

6. The heat exchanger of claim 1, wherein the first end of the annular core is open, wherein the second end of the annular core is open, and wherein the inner surface further includes a flow directing feature spanning the inner diameter at a region between the first end and the second end of the annular core.

7. The heat exchanger of claim 6, wherein the flow directing feature is a dividing plate.

8. The heat exchanger of claim 6, wherein the flow directing feature is a double-cone configuration, the double-cone configuration further comprising:
a base having a diameter that fits within the inner diameter;
a first vertex, wherein the first vertex extends towards the first end of the annular core; and
a second vertex, wherein the second vertex extends towards the second end of the annular core.

9. The heat exchanger of claim 1, wherein each fin of the first plurality of fins and the second plurality of fins is sandwiched between two plates of the plurality of plates.

10. The heat exchanger of claim 1, and further comprising an exhaust tube connected to the exhaust shell.

11. A heat exchanger comprising:
an exhaust shell;
an annular core contained within the exhaust shell, the annular core comprising:
a first end;
a second end that is axially opposite to the first end;
an outer diameter defining an outer surface;
inner diameter defining an inner surface, wherein the inner diameter changes from the first end to the second end;
a first plurality of fins extending in a first direction between the inner diameter and the outer diameter in a first set of layers, the first plurality of fins further comprising:
a first inlet; and
a first outlet fluidly connected to the first inlet; and
a second plurality of fins extending in a second direction between the inner diameter and the outer diameter in a second set of layers, the second plurality of fins further comprising:
a first inlet manifold; and
a first outlet manifold fluidly connected to the first inlet manifold; and
a plurality of plates separating the first set of layers from the second set of layers.

12. The heat exchanger of claim 11, wherein the first direction is a radial direction, and wherein the second direction is a circumferential direction.

13. The heat exchanger of claim 11, wherein the second end of the annular core includes a cone, the cone further comprising:
a curved surface; and
a vertex at an end of the curved surface, wherein the vertex extends towards the first end of the annular core.

14. The heat exchanger of claim 11, wherein the first end of the annular core is open, wherein the second end of the annular core is open, and wherein the inner surface further includes a flow directing feature spanning the inner diameter at a region between the first end and the second end of the annular core, the flow directing feature being either a dividing plate or a double-cone configuration.

15. The heat exchanger of claim 11, wherein the annular core is tapered.

16. The heat exchanger of claim 15, wherein the inner diameter and the outer diameter decrease proportionally from the first end to the second end of the annular core.

17. The heat exchanger of claim 16, wherein the annular core is divided longitudinally into staggered sections that each have a same radial height.

18. The heat exchanger of claim 15, wherein the annular core is divided longitudinally into sections that have increasing radial heights between consecutive sections from the first end to the second end of the annular core.

* * * * *